US007372349B2

(12) United States Patent
Wheeler et al.

(10) Patent No.: US 7,372,349 B2
(45) Date of Patent: May 13, 2008

(54) APPARATUS UTILIZING LATCHING MICROMAGNETIC SWITCHES

(75) Inventors: Charles Wheeler, Paradise Valley, AZ (US); Jun Shen, Phoenix, AZ (US); Meichun Ruan, Tempe, AZ (US)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 11/483,192

(22) Filed: Jul. 10, 2006

(65) Prior Publication Data

US 2007/0018762 A1 Jan. 25, 2007

Related U.S. Application Data

(63) Continuation of application No. 11/012,078, filed on Dec. 15, 2004, now abandoned, which is a continuation of application No. 10/147,918, filed on May 20, 2002, now abandoned.

(60) Provisional application No. 60/291,651, filed on May 18, 2001.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 4,065,677 A 12/1977 Micheron et al.
4,461,968 A 7/1984 Kolm et al.
4,496,211 A 1/1985 Daniel
4,570,139 A 2/1986 Kroll
5,016,978 A 5/1991 Fargette et al.
5,048,912 A 9/1991 Kunikane et al.
5,398,011 A 3/1995 Kimura et al.
5,472,539 A 12/1995 Saia et al.
5,475,353 A 12/1995 Roshen et al.
5,557,132 A 9/1996 Takahashi (Continued)

FOREIGN PATENT DOCUMENTS

DE 19820821 C1 12/1999

(Continued)

OTHER PUBLICATIONS

Search Report, dated Oct. 18, 2006, for EPO Patent Application No. 02739292.7-2214 PCT/US0215832, 3 pages.

(Continued)

*Primary Examiner*—Elvin Enad
*Assistant Examiner*—Bernard Rojas
(74) *Attorney, Agent, or Firm*—Sterne, Kessler, Goldstein & Fox, PLLC

(57) ABSTRACT

An apparatus includes an electrical device and a latching micromagnetic switch that controls energy flow through the electrical device. The latching micromagnetic switch includes a cantilever, a permanent magnet, and a coil configured to latch the latching micromagnetic switch in one of two positions each time energy passes through the coil. The electrical device and the latching micromagnetic switch can be integrated on a same substrate. Otherwise, the electrical device and the latching micromagnetic switch can be located on separate substrates and coupled together. The electrical device can be a circuit, a filter, an antenna, a transceiver, or the like.

16 Claims, 21 Drawing Sheets

U.S. PATENT DOCUMENTS

| | | | |
|---|---|---|---|
| 5,629,918 | A | 5/1997 | Ho et al. |
| 5,696,619 | A | 12/1997 | Knipe et al. |
| 5,784,190 | A | 7/1998 | Worley |
| 5,818,316 | A | 10/1998 | Shen et al. |
| 5,838,847 | A | 11/1998 | Pan et al. |
| 5,847,631 | A | 12/1998 | Taylor et al. |
| 5,898,515 | A | 4/1999 | Furlani et al. |
| 5,945,898 | A | 8/1999 | Judy et al. |
| 5,982,554 | A | 11/1999 | Goldstein et al. |
| 6,016,092 | A | 1/2000 | Qiu et al. |
| 6,016,095 | A | 1/2000 | Herbert |
| 6,025,767 | A | 2/2000 | Kellam et al. |
| 6,028,689 | A | 2/2000 | Michalicek et al. |
| 6,046,659 | A | 4/2000 | Loo et al. |
| 6,078,016 | A | 6/2000 | Yoshikawa et al. |
| 6,084,281 | A | 7/2000 | Fullin et al. |
| 6,094,116 | A | 7/2000 | Tai et al. |
| 6,094,293 | A | 7/2000 | Yokoyama et al. |
| 6,100,477 | A | 8/2000 | Randall et al. |
| 6,115,231 | A | 9/2000 | Shirakawa |
| 6,124,650 | A | 9/2000 | Bishop et al. |
| 6,127,908 | A | 10/2000 | Bozler et al. |
| 6,133,807 | A | 10/2000 | Akiyama et al. |
| 6,143,997 | A | 11/2000 | Feng et al. |
| 6,153,839 | A | 11/2000 | Zavracky et al. |
| 6,160,230 | A | 12/2000 | McMillen et al. |
| 6,320,145 | B1 | 11/2001 | Tai et al. |
| 6,410,360 | B1 | 6/2002 | Steenberge |
| 6,440,767 | B1 | 8/2002 | Loo et al. |
| 6,469,602 | B2 | 10/2002 | Ruan et al. |
| 6,469,603 | B1 | 10/2002 | Ruan et al. |
| 6,496,612 | B1 | 12/2002 | Ruan et al. |
| 6,528,869 | B1 | 3/2003 | Glenn et al. |
| 6,750,745 | B1 | 6/2004 | Wei et al. |
| 6,794,965 | B2 | 9/2004 | Shen et al. |
| 6,865,268 | B1 | 3/2005 | Matthews et al. |
| 6,894,592 | B2 | 5/2005 | Shen et al. |
| 7,023,304 | B2 | 4/2006 | Shen et al. |
| 2002/0118084 | A1 | 8/2002 | Lim et al. |
| 2002/0196110 | A1 | 12/2002 | Vaitkus et al. |
| 2003/0025580 | A1 | 2/2003 | Wheeler et al. |
| 2003/0179058 | A1 | 9/2003 | Vaitkus et al. |
| 2005/0285703 | A1 | 12/2005 | Wheeler et al. |

FOREIGN PATENT DOCUMENTS

| | | | |
|---|---|---|---|
| DE | 10031569 | A1 | 2/2001 |
| EP | 0452012 | A2 | 10/1991 |
| EP | 0452012 | A3 | 10/1991 |
| EP | 0685864 | A1 | 12/1995 |
| EP | 0709911 | A2 | 5/1996 |
| EP | 0709911 | A3 | 5/1996 |
| EP | 0780858 | A1 | 6/1997 |
| EP | 0869519 | A1 | 10/1998 |
| EP | 0887879 | A1 | 12/1998 |
| FR | 2572546 | A1 | 5/1986 |
| JP | 54-161952 | | 12/1979 |
| JP | 4-275519 | | 10/1992 |
| JP | 6-251684 | | 9/1994 |
| WO | WO 97/39468 | | 10/1997 |
| WO | WO 98/06118 | A1 | 2/1998 |
| WO | WO 98/34269 | | 8/1998 |
| WO | WO 99/27548 | | 6/1999 |
| WO | WO 00/44020 | A2 | 7/2000 |
| WO | WO 01/57899 | A1 | 8/2001 |
| WO | WO 01/84211 | A2 | 11/2001 |

OTHER PUBLICATIONS

Richard P. Feymann, "There's Plenty of Room at the Bottom", Dec. 29, 1959, pp. 1-12, Internet Source: http://222.zyvex.com/nanotech/feynman.html.

E. Fullin, J. Gobet, H.A.C. Tilmans, and J. Bergvist, "A New Basic Technology for Magnetic Micro-Actuators", pp. 143-147.

Jack W. Judy and Richard S. Muller "Magnetically Actuated, Addressable Microstructures", Sep. 1997, Journal of Microelectromechanical Systems, vol. 6, No. 3, Sep. 1997, pp. 249-255.

Ezekiel JJ Kruglick and Kristofer SJ Pister, "Project Overview: Micro-Relays", Tech. Digital Solid-State Sensor and Actuator Workshop, 1998, Hilton Head 98 and 19th International Conference on Electric Contact Phenomena, Nuremberg, Germany, Sep. 1998 (Downloaded from Internet Source: http://www-bsac.eecs.berkeley.edu/Kruglick/relays/relays.html, on Jul. 12, 1999) 2 pgs.

Ezekiel J.J. Kruglick and Kristofer S.J. Pister, "Bistable MEMS Relays and Contact Characterization", Tech. Digital Solid-State Sensor and Actuator Workshop, Hilton Head, 1988 and 19th International Conference on Electric Contact Phenomena, Nuremberg, Germany, Sep. 1998, 5 pgs.

Laure K. Lagorce and Oliver Brand, "Magnetic Microactuators Based on Polymer Magnets", Mar. 1999, IEEE Journal of Microelectromechanical Systems, IEEE, vol. 8., No. 1., Mar. 1999, 8 pages.

"P10D Electricity & Magnetism Lecture 14", Internet Source: http://scitec.uwhichill.edu.bb/cmp/online/P10D/Lecture14/lect14.htn, Jan. 3, 2000, pp. 1-5.

"Ultraminiature Magnetic Latching to 5-relays SPDT DC TO C Band", Series RF 341, product information from Teledyne Relays, 1998.

M. Ruan et al., "Latching Microelectromagnetic Relays", Sensors and Actuators A 91 (Jul. 15, 2001), Copyright 2001 Elsevier Science B.V., pp. 346-350.

Xi-Qing Sun, K. R. Farmer, W.N. Carr, "A Bistable Microrelay Based on Two-Segment Multimorph Cantilever Actuators", 11th Annual Workshop on Micro Electrical Mechanical Systems, Heidelberg, Germany, IEEE, Jan. 25-29, 1998, pp. 154-159.

William P. Taylor and Mark G. Allen, "Integrated Magnetic Microrelays: Normally Open, Normally Closed, and Multi-Pole Devices", 1997 International Conference on Solid-State Sensors and Actuators, IEEE, Jun. 16-19, 1997, pp. 1149-1152.

William P. Taylor, Oliver Brand, and Mark G. Allen. "Fully Integrated Magnetically Actuated Micromachined Relays", Journal of Microelectromechanical Systems, IEEE, vol. 7, No. 2, Jun. 1998, pp. 181-191.

Tilmans, et al., "A Fully-Packaged Electromagnetic Microrelay", Proc. MEMS '99, Orlando, FL, Jan. 17-21, 1999, copyright IEEE 1999, pp. 25-30.

William Trimmer, "The Scaling of Micromechanical Devices", Internet Source: http://home.earthlink.net/-trimmerw/mems/scale.html on Jan. 3, 2000 (adapted from article Microrobots and Micromechanical Systems by W.S.N. Trimmer, Sensors and Actuators, vol. 19, No. 3, Sep. 1989, pp. 267-287, and other sources).

John A. Wright and Yu-Chong Tai, "Micro-Miniature Electromagnetic Switches Fabricated Using MEMS Technology", Proceedings: 46th Annual International Relay Conference: NARM '98, Apr. 1998, pp. 13-1 to 13-4.

John A. Wright, Yu-Chong Tai and Gerald Lilienthal, "A Magnetostatic MEMS Switch for DC Brushless Motor Commutation", Proceedings Solid State Sensor and Actuator Workshop, Hilton Head, Jun. 1998, pp. 304-307.

John A. Wright, Yu-Chong Tai, and Shih-Chia Chang, "A Large-Force, Fully-Integrated MEMS Magnetic Actuator", Tranducers '97, 1997 International Conference on Solid State Sensors and Actuators, Chicago, Jun. 16-19, 1997.

Ann, Chong H. & Allen, Mark G., A Fully Integrated Micromagnetic Actuator With A Multilevel Meander Magnetic Core, 1992 IEEE, Solid-State Sensor and Actuator Workshop, Technical Digest, Hilton Head Island, South Carolina, Jun. 22-25, 1992, Technical Digest, pp. 14-17.

Written Opinion received in International Application No. PCT/US02/15832, mailed Apr. 11, 2003, 4 pages.

International Search Report for International Application No. PCT/US02/15832, mailed on Sep. 6, 2002, 6 pgs.

APPARATUS UTILIZING LATCHING MICROMAGNETIC SWITCHES

CROSS REFERENCE TO RELATED APPLICATIONS

This application is a continuation of U.S. application Ser. No. 11/012,078, filed Dec. 15, 2004 (now abandoned), which is a continuation of U.S. application Ser. No. 10/147,918, filed May 20, 2002 (now abandoned), which claims priority under 35 U.S.C. § 119(e) to U.S. Prov. Patent App. No. 60/291,651, filed May 18, 2001, which are both incorporated by reference herein in their entireties.

The application is related to U.S. application Ser. No. 10/147,915, entitled, "MICROMAGNETIC LATCHING SWITCH PACKAGING," filed May 20, 2002 (now U.S. Pat. No. 6,894,592 that issued May 17, 2005), which is incorporated by reference herein in its entirety.

BACKGROUND OF THE INVENTION

1. Field of the Invention

The present invention relates to an electrical apparatus having an electronic device with its energy flow controlled by switches.

2. Background Art

Switches are typically electrically controlled two-state devices that open and close contacts to effect operation of devices in an electrical or optical circuit. Relays, for example, typically function as switches that activate or deactivate portions of electrical, optical or other devices. Relays are commonly used in many applications including telecommunications, radio frequency (RF) communications, portable electronics, consumer and industrial electronics, aerospace, and other systems. More recently, optical switches (also referred to as "optical relays" or simply "relays" herein) have been used to switch optical signals (such as those in optical communication systems) from one path to another.

While conventional relays are mechanical or solid-state devices, recent developments in micro-electro-mechanical systems (MEMS) technologies and microelectronics manufacturing have made new types of micro electrostatic and micromagnetic relays possible. Such micromagnetic relays typically include an electromagnet that energizes an armature to make or break an electrical contact. When the magnet is de-energized, a spring or other mechanical force typically restores the armature to a quiescent position. Such relays typically exhibit a number of marked disadvantages, however, in that they generally exhibit only a single stable output (i.e., the quiescent state) and they are not latching (i.e., they do not retain a constant output as power is removed from the relay). Moreover, the spring required by conventional micromagnetic relays may degrade or break over time.

Non-latching micromagnetic relay switches are known. Such relays include a permanent magnet and an electromagnet for generating a magnetic field that intermittently opposes the field generated by the permanent magnet. The replay must consume power in the electromagnet to maintain at least one of the output states. Moreover, the power required to generate the opposing field would be significant, thus making the relay less desirable for use in space, portable electronics, and other applications that demand low power consumption.

The basic elements of a micromagnetic latching switch include a permanent magnet, a substrate, a coil, and a cantilever at least partially made of soft magnetic materials.

In its optimal configuration, the permanent magnet produces a static magnetic field that is relatively perpendicular to the horizontal plane of the cantilever. However, the magnetic field lines produced by a permanent magnet with a typical regular shape (disk, square, etc.) are not necessarily perpendicular to a plane, especially at the edge of the magnet. Then, any horizontal component of the magnetic field due to the permanent magnet can either eliminate one of the bistable states or greatly increase the current that is needed to switch the cantilever from one state to the other. Careful alignment of the permanent magnet relative to the cantilever so as to locate the cantilever in the right spot of the permanent magnet field (usually near the center) will permit bi-stability and minimize switching current. Nevertheless, high-volume production of the switch can become difficult and costly if the alignment error tolerance is small.

A bi-stable, latching switch that has a very low series resistance value and that does not require power to hold the state is therefore desired. Such a switch should also be reliable, simple in design, low-cost and easy to manufacture, and should be useful in optical and/or electrical environments.

BRIEF SUMMARY OF THE INVENTION

The latching micromagnetic switch of the present invention can be used in a plethora of products including household and industrial appliances, consumer electronics, military hardware, medical devices and vehicles of all types, just to name a few broad categories of goods. The latching micromagnetic switch of the present invention has the advantages of compactness, simplicity of fabrication, and has good performance at high frequencies.

Embodiments of the present invention provide an apparatus including an electrical device and a latching micromagnetic switch that controls energy flow through the electrical device. The latching micromagnetic switch includes a cantilever, a permanent magnet, and a coil configured to latch the latching micromagnetic switch in one of two positions each time energy passes through the coil.

In some embodiments the electrical device and the latching micromagnetic switch are integrated on a same substrate.

In some embodiments the electrical device and the latching micromagnetic switch are located on separate substrates and coupled together.

Other embodiments of the present invention provide an electrical apparatus comprising an electrical device and a latching micromagnetic switch. The switch includes a dual-layer cantilever, an embedded coil, and a permanent magnet.

Other embodiments of the present invention provide an electrical apparatus comprising a plurality of filters and a plurality of pairs of latching micromagnetic switches. Each one of the pairs of the micromagnetic switches is positioned such that a first switch in the pair of switches is at an input to a corresponding one of the plurality of filters and a second switch in the pair of switches is at an output of the corresponding one of the plurality of filters.

Other embodiments of the present invention provide an electrical apparatus comprising a transceiver having a transmit differential pair and a receive differential pair, a first latching micromagnetic switch that controls energy flowing through the transmit differential pair, and a second latching micromagnetic switch that controls energy flowing through the receive differential pair.

Other embodiments of the present invention provide an electrical apparatus comprising an antenna having multiple conductive traces and a plurality of latching micromagnetic switches. The plurality of switches couple adjacent ones of the multiple conductive traces to control energy flow through the antenna to tune the antenna.

An advantage of embodiments of the present invention is that they provide a bi-stable, latching switch that has a very low impedance value and that does not require power to hold the states.

Further embodiments, features, and advantages of the present inventions, as well as the structure and operation of the various embodiments of the present invention, are described in detail below with reference to the accompanying drawings.

BRIEF DESCRIPTION OF THE FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1A:
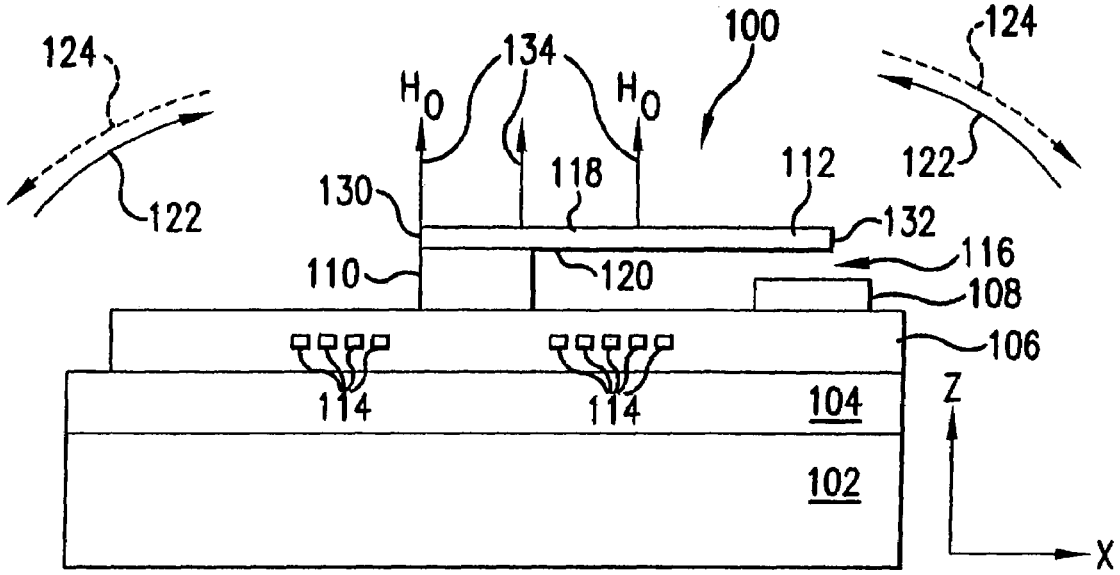
FIGS. 1A and 1B are side and top views, respectively, of an exemplary embodiment of a switch.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Introduction

It should be appreciated that the particular implementations shown and described herein are examples of the invention and are not intended to otherwise limit the scope of the present invention in any way. Indeed, for the sake of brevity, conventional electronics, manufacturing, MEMS technologies and other functional aspects of the systems (and components of the individual operating components of the systems) may not be described in detail herein. Furthermore, for purposes of brevity, the invention is frequently described herein as pertaining to a micro-electronically-machined relay for use in electrical or electronic systems. It should be appreciated that many other manufacturing techniques could be used to create the relays described herein, and that the techniques described herein could be used in mechanical relays, optical relays or any other switching device. Further, the techniques would be suitable for application in electrical systems, optical systems, consumer electronics, industrial electronics, wireless systems, space applications, or any other application.

The terms, chip, integrated circuit, monolithic device, semiconductor device, and microelectronic device, are often used interchangeably in this field. The present invention is applicable to all the above as they are generally understood in the field.

The terms metal line, interconnect line, trace, wire, conductor, signal path and signaling medium are all related. The related terms listed above, are generally interchangeable, and appear in order from specific to general. In this field, metal lines are sometimes referred to as traces, wires, lines, interconnect or simply metal. Metal lines, generally gold (Au), aluminum (Al), copper (Cu) or an alloy of Al and Cu, are conductors that provide signal paths for coupling or interconnecting, electrical circuitry. Conductors other than metal are available in microelectronic devices. Materials such as doped polysilicon, doped single-crystal silicon (often referred to simply as diffusion, regardless of whether such doping is achieved by thermal diffusion or ion implantation), titanium (Ti), molybdenum (Mo), and refractory metal suicides are examples of other conductors.

The terms contact and via, both refer to structures for electrical connection of conductors from different interconnect levels. These terms are sometimes used in the art to describe both an opening in an insulator in which the structure will be completed, and the completed structure itself. For purposes of this disclosure contact and via refer to the completed structure.

The term vertical, as used herein, means substantially orthogonal to the surface of a substrate. Moreover, it should be understood that the spatial descriptions (e.g., "above", "below", "up", "down", "top", "bottom", etc.) made herein are for purposes of illustration only, and that practical latching relays can be spatially arranged in any orientation or manner.

The above-described micromagnetic latching switch is further described in international patent publications WO01 57899 (titled Electronically Switching Latching Micromagnetic Relay And Method of Operating Same), which claims priority to U.S. Pat. No. 6,469,602, and WO0184211 (titled Electronically Micromagnetic latching switches and Method of Operating Same), which claims priority to U.S. Pat. No. 6,496,612, to Ruan et al. These patent publications provide a thorough background on micromagnetic latching switches and are incorporated herein by reference in their entirety. Moreover, the details of the switches disclosed in WO0157899 and WO0184211 are applicable to implement the switch embodiments of the present invention as described below.

Overview of a Latching Switch

Figure 1B:
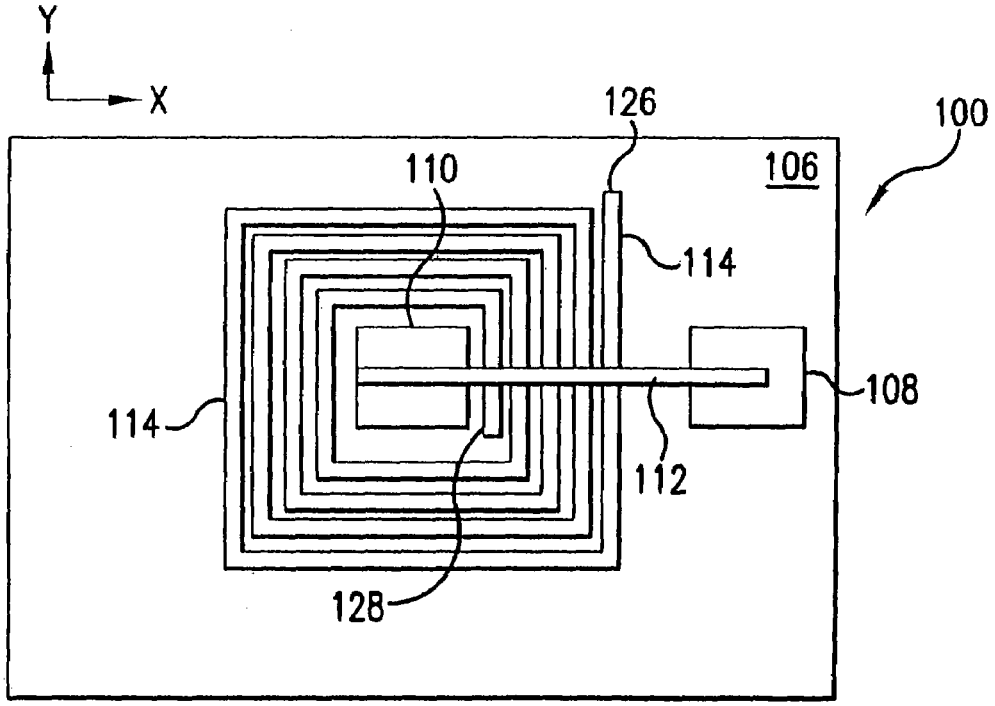

FIGS. 1A and 1B show side and top views, respectively, of a latching switch. The terms switch and device are used herein interchangeably to described the structure of the present invention. With reference to FIGS. 1A and 1B, an exemplary latching relay 100 suitably includes a magnet 102, a substrate 104, an insulating layer 106 housing a conductor 114, a contact 108 and a cantilever (moveable element) 112 positioned or supported above substrate 104 by a staging layer 110.

Magnet 102 is any type of magnet such as a permanent magnet, an electromagnet, or any other type of magnet capable of generating a magnetic field $H_0$ 134, as described more fully below. By way of example and not limitation, the magnet 102 can be a model 59-P09213T001 magnet available from the Dexter Magnetic Technologies corporation of Fremont, Calif., although of course other types of magnets could be used. Magnetic field 134 can be generated in any manner and with any magnitude, such as from about 1 Oersted to $10^4$ Oersted or more. The strength of the field depends on the force required to hold the cantilever in a given state, and thus is implementation dependent. In the exemplary embodiment shown in FIG. 1, magnetic field $H_0$ 134 can be generated approximately parallel to the Z axis and with a magnitude on the order of about 370 Oersted, although other embodiments will use varying orientations and magnitudes for magnetic field 134. In various embodiments, a single magnet 102 can be used in conjunction with a number of relays 100 sharing a common substrate 104.

Substrate 104 is formed of any type of substrate material such as silicon, gallium arsenide, glass, plastic, metal or any other substrate material. In various embodiments, substrate 104 can be coated with an insulating material (such as an oxide) and planarized or otherwise made flat. In various embodiments, a number of latching relays 100 can share a single substrate 104. Alternatively, other devices (such as transistors, diodes, or other electronic devices) could be formed upon substrate 104 along with one or more relays 100 using, for example, conventional integrated circuit manufacturing techniques. Alternatively, magnet 102 could be used as a substrate and the additional components discussed below could be formed directly on magnet 102. In such embodiments, a separate substrate 104 may not be required.

Insulating layer 106 is formed of any material such as oxide or another insulator such as a thin-film insulator. In an exemplary embodiment, insulating layer is formed of Probimide 7510 material. Insulating layer 106 suitably houses conductor 114. Conductor 114 is shown in FIGS. 1A and 1B to be a single conductor having two ends 126 and 128 arranged in a coil pattern. Alternate embodiments of conductor 114 use single or multiple conducting segments arranged in any suitable pattern such as a meander pattern, a serpentine pattern, a random pattern, or any other pattern. Conductor 114 is formed of any material capable of conducting electricity such as gold, silver, copper, aluminum, metal or the like. As conductor 114 conducts electricity, a magnetic field is generated around conductor 114 as discussed more fully below.

Cantilever (moveable element) 112 is any armature, extension, outcropping or member that is capable of being affected by magnetic force. In the embodiment shown in FIG. 1A, cantilever 112 suitably includes a magnetic layer 118 and a conducting layer 120. Magnetic layer 118 can be formulated of permalloy (such as NiFe alloy) or any other magnetically sensitive material. Conducting layer 120 can be formulated of gold, silver, copper, aluminum, metal or any other conducting material. In various embodiments, cantilever 112 exhibits two states corresponding to whether relay 100 is "open" or "closed", as described more fully below. In many embodiments, relay 100 is said to be "closed" when a conducting layer 120, connects staging layer 110 to contact 108. Conversely, the relay may be said to be "open" when cantilever 112 is not in electrical contact with contact 108. Because cantilever 112 can physically move in and out of contact with contact 108, various embodiments of cantilever 112 will be made flexible so that cantilever 112 can bend as appropriate. Flexibility can be created by varying the thickness of the cantilever (or its various component layers), by patterning or otherwise making holes or cuts in the cantilever, or by using increasingly flexible materials.

Alternatively, cantilever 112 can be made into a "hinged" arrangement (such as that described below in conjunction with FIG. 12). Although of course the dimensions of cantilever 112 can vary dramatically from implementation to implementation, an exemplary cantilever 112 suitable for use in a micromagnetic relay 100 can be on the order of 10-1000 microns in length, 1-40 microns in thickness, and 2-600 microns in width. For example, an exemplary cantilever in accordance with the embodiment shown in FIG. 1 can have dimensions of about 600 microns×10 microns×50 microns, or 1000 microns×600 microns×25 microns, or any other suitable dimensions.

Contact 108 and staging layer 110 are placed on insulating layer 106, as appropriate. In various embodiments, staging layer 110 supports cantilever 112 above insulating layer 106, creating a gap 116 that can be vacuum or can become filled with air or another gas or liquid such as oil. Although the size of gap 116 varies widely with different implementations, an exemplary gap 116 can be on the order of 1-100 microns, such as about 20 microns, Contact 108 can receive cantilever 112 when relay 100 is in a closed state, as described below, Contact 108 and staging layer 110 can be formed of any conducting material such as gold, gold alloy, silver, copper, aluminum, metal or the like. In various embodiments, contact 108 and staging layer 110 are formed of similar conducting materials, and the relay is considered to be "closed" when cantilever 112 completes a circuit between staging layer 110 and contact 108. In certain embodiments wherein cantilever 112 does not conduct electricity, staging layer 110 can be formulated of non-conducting material such as Probimide material, oxide, or any other material. Additionally, alternate embodiments may not require staging layer 110 if cantilever 112 is otherwise supported above insulating layer 106.

Principle of Operation of a Micromagnetic Latching Switch

When it is in the "down" position, the cantilever makes electrical contact with the bottom conductor, and the switch is "on" (also called the "closed" state). When the contact end is "up", the switch is "off" (also called the "open" state). These two stable states produce the switching function by the moveable cantilever element. The permanent magnet holds the cantilever in either the "up" or the "down" position after switching, making the device a latching relay. A current is passed through the coil (e.g., the coil is energized) only during a brief (temporary) period of time to transition between the two states.

(i) Method to Produce Bi-Stability

Figure 2:
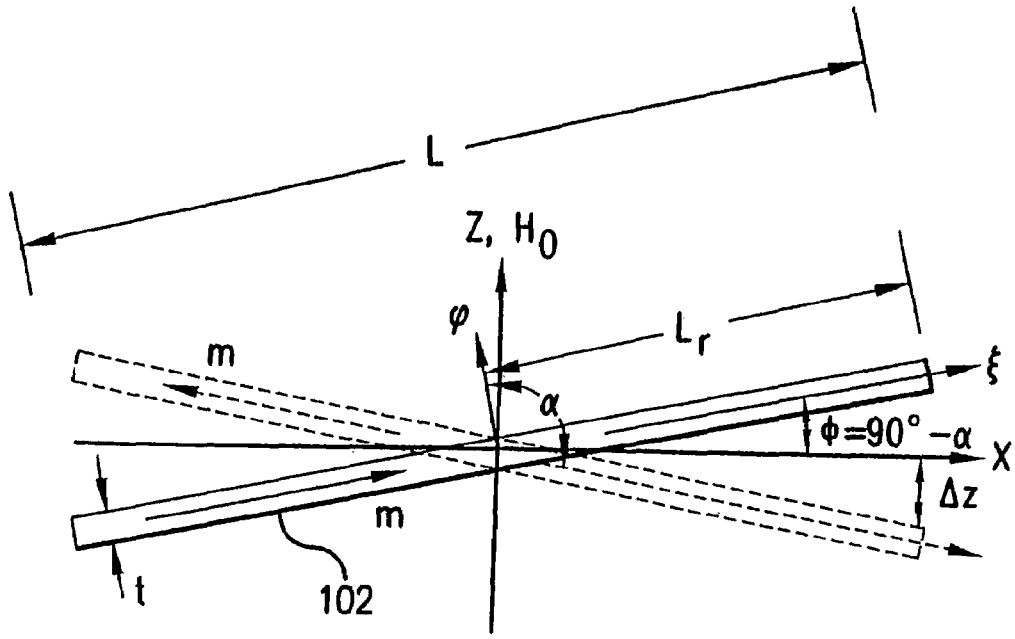
FIG. 2 illustrates the principle by which bi-stability is produced.

The principle by which bi-stability is produced is illustrated with reference to FIG. 2. When the length L of a permalloy cantilever 102 is much larger than its thickness t and width (w, not shown), the direction along its long axis L becomes the preferred direction for magnetization (also called the "easy axis"). When a major central portion of the cantilever is placed in a uniform permanent magnetic field, a torque is exerted on the cantilever. The torque can be either clockwise or counterclockwise, depending on the initial orientation of the cantilever with respect to the magnetic field. When the angle ($\alpha$) between the cantilever axis ($\xi$) and the external field ($H_0$) is smaller than 90°, the torque is counterclockwise. When $\alpha$ is larger than 90°, the torque is clockwise. The bidirectional torque arises because of the bidirectional magnetization (i.e., a magnetization vector "m" points one direction or the other direction, as shown in FIG. 2) of the cantilever (m points from left to right when $\alpha<90°$, and from right to left when $\alpha>90°$). Due to the torque, the cantilever tends to align with the external magnetic field ($H_0$). However, when a mechanical force (such as the elastic torque of the cantilever, a physical stopper, etc.) preempts to the total realignment with $H_0$, two stable positions ("up" and "down") are available, which forms the basis of latching in the switch.

(ii) Electrical Switching

If the bidirectional magnetization along the easy axis of the cantilever arising from $H_0$ can be momentarily reversed by applying a second magnetic field to overcome the influence of ($H_0$), then it is possible to achieve a switchable latching relay. This scenario is realized by situating a planar coil under or over the cantilever to produce the required temporary switching field. The planar coil geometry was chosen because it is relatively simple to fabricate, though other structures (such as a wraparound, three-dimensional type) are also possible. The magnetic field (Hcoil) lines generated by a short current pulse loop around the coil. It is mainly the $\xi$-component (along the cantilever, see FIG. 2) of this field that is used to reorient the magnetization (magnetization vector "m") in the cantilever. The direction of the coil current determines whether a positive or a negative $\xi$-field component is generated. Plural coils can be used. After switching, the permanent magnetic field holds the cantilever in this state until the next switching event is encountered. Since the $\xi$-component of the coil-generated field (Hcoil-$\xi$) only needs to be momentarily larger than the $\xi$-component [$H_0\xi \sim H_0\cos(\alpha)=H_0\sin(\phi)$, $\alpha=90°-\phi$] of the permanent magnetic field and $\phi$ is typically very small (e.g., $\phi \leqq 5°$), switching current and power can be very low, which is an important consideration in micro relay design.

The operation principle can be summarized as follows: A permalloy cantilever in a uniform (in practice, the field can be just approximately uniform) magnetic field can have a clockwise or a counterclockwise torque depending on the angle between its long axis (easy axis, L) and the field. Two bistable states are possible when other forces can balance die torque. A coil can generate a momentary magnetic field to switch the orientation of magnetization (vector m) along the cantilever and thus switch the cantilever between the two states.

Relaxed Alignment of Magnets

To address the issue of relaxing the magnet alignment requirement, the inventors have developed a technique to create perpendicular magnetic fields in a relatively large region around the cantilever. The invention is based on the fact that the magnetic field lines in a low permeability media (e.g., air) are basically perpendicular to the surface of a very high permeability material (e.g., materials that are easily magnetized, such as permalloy). When the cantilever is placed in proximity to such a surface and the cantilever's horizontal plane is parallel to the surface of the high permeability material, the above stated objectives can be at least partially achieved. The generic scheme is described below, followed by illustrative embodiments of the invention.

The boundary conditions for the magnetic flux density (B) and magnetic field (H) follow the following relationships:

$$B_2 \cdot n = B_1 \cdot n,\ B_2 \times n = (\mu_2/\mu_1) B_1 \times n$$

or $$H_2 \cdot n = (\mu_2/\mu_1) H_1 \cdot n,\ H_2 \times n = H_1 \times n$$

Figure 3:
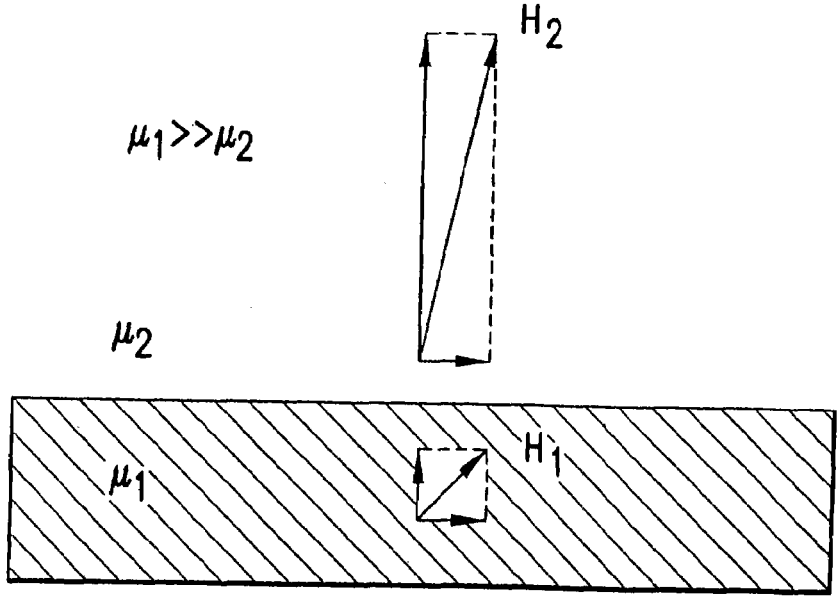
FIG. 3 illustrates the boundary conditions on the magnetic field (H) at a boundary between two materials with different permeability (m1>>m2).

If $\mu_1 >> \mu_2$, the normal component of $H_2$ is much larger than the normal component of $H_1$, as shown in FIG. 3. In the limit $(\mu_1/\mu_2) \rightarrow \infty$, the magnetic field $H_2$ is normal to the boundary surface, independent of the direction of $H_1$ (barring the exceptional case of $H_1$ exactly parallel to the interface). If the second media is air ($\mu_2=1$), then $B_2=\mu_0 H_2$, so that the flux lines $B_2$ will also be perpendicular to the surface. This property is used to produce magnetic fields that are perpendicular to the horizontal plane of the cantilever in a micromagnetic latching switch and to relax the permanent magnet alignment requirements.

Figure 4A:
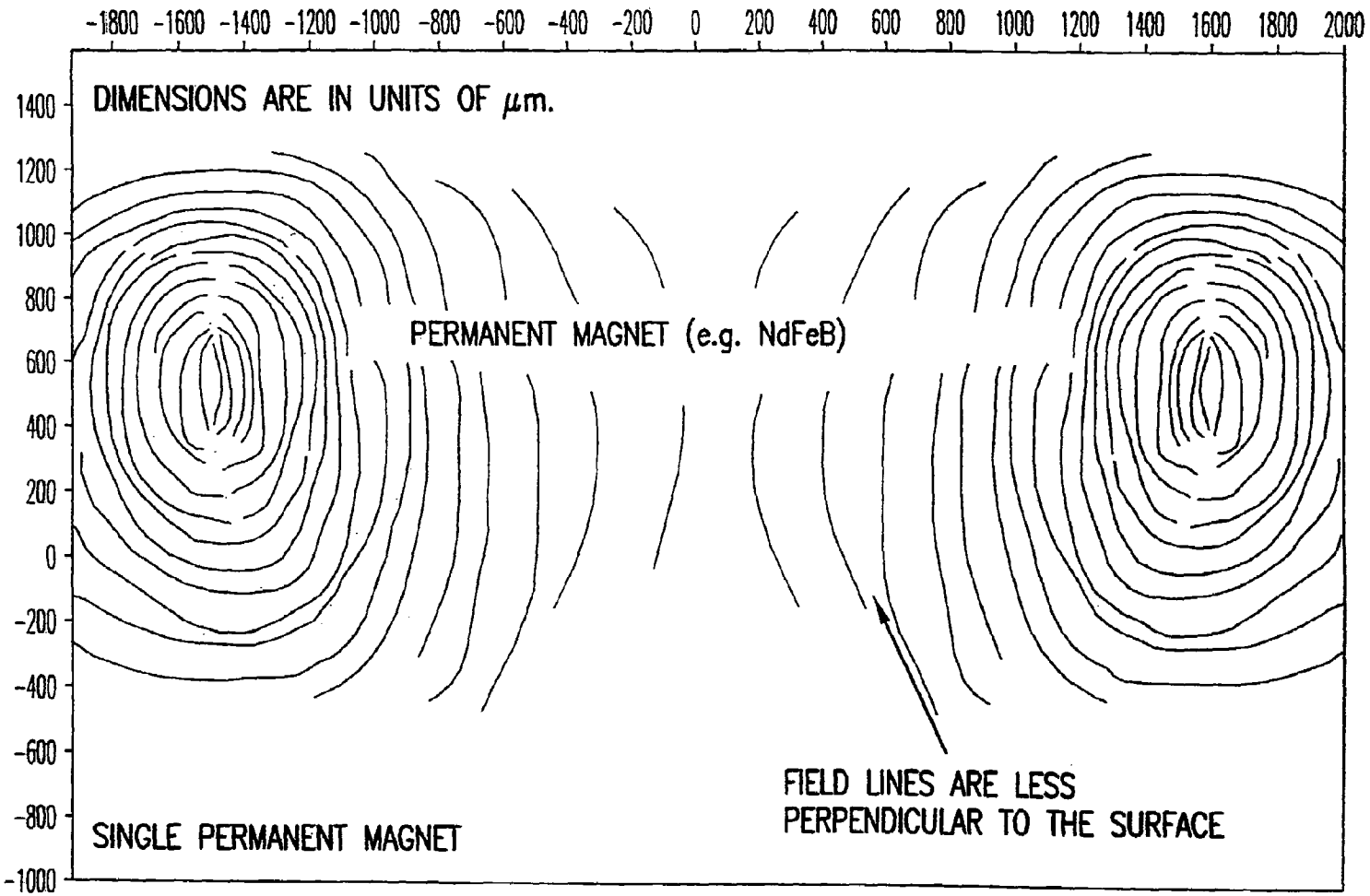
FIGS. 4A-4B shows the computer simulation of magnetic flux distributions, according to the present invention.
Figure 4B:
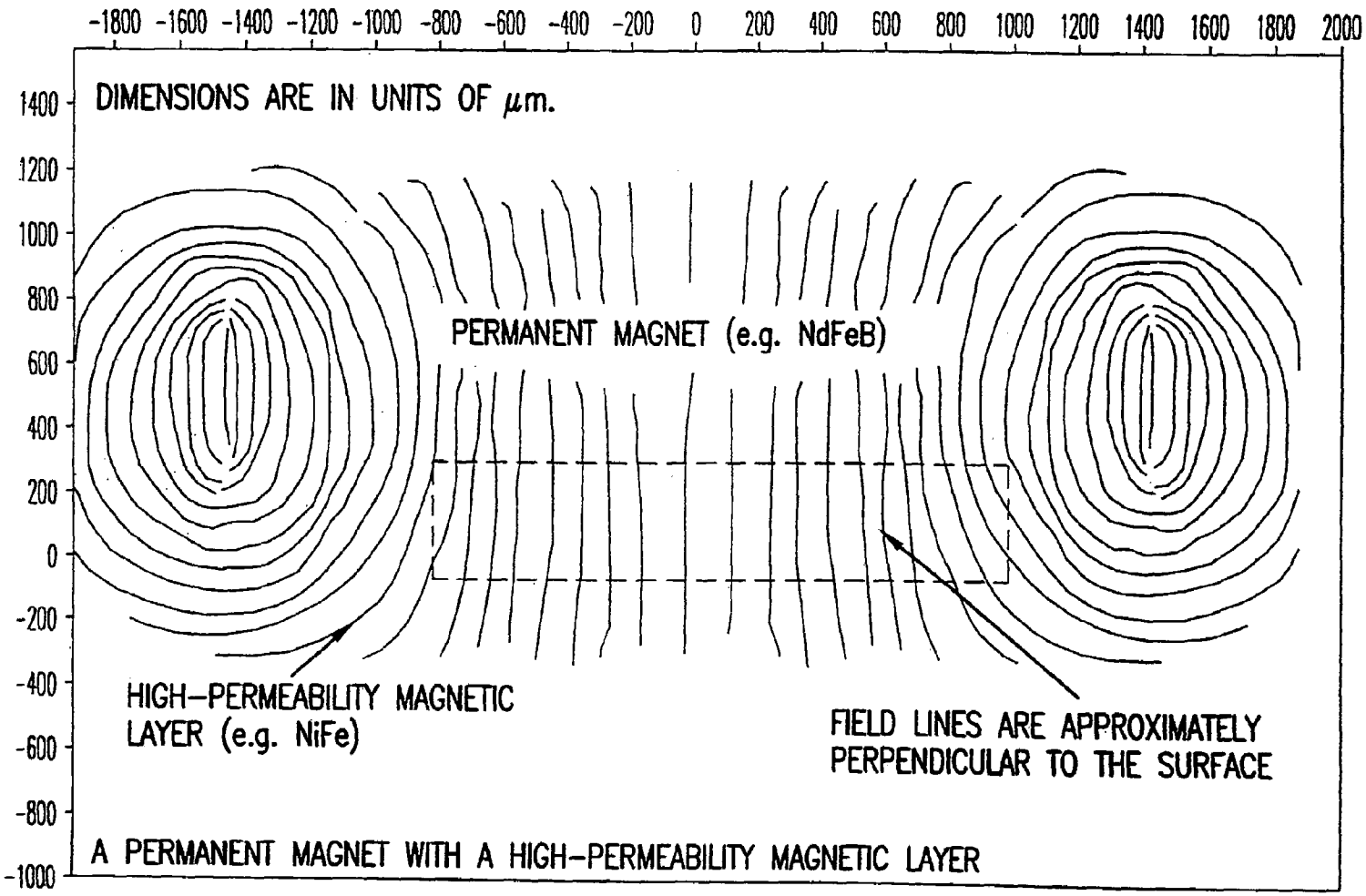

FIGS. 4A and 4B shows the computer simulation of magnetic flux (B) distributions. As can be seen, without the high-permeability magnetic layer (a), the flux lines are less perpendicular to the horizontal plane, resulting in a large horizontal (x) component. The magnetic flux lines are approximately perpendicular to the horizontal plane in a relatively large region when a high-permeability magnetic layer is introduced with its surface parallel to horizontal plane (b). The region indicated by the box with dashed lines will be the preferred location of the switch with the cantilever horizontal plane parallel to the horizontal axis (x).

Figure 5A:
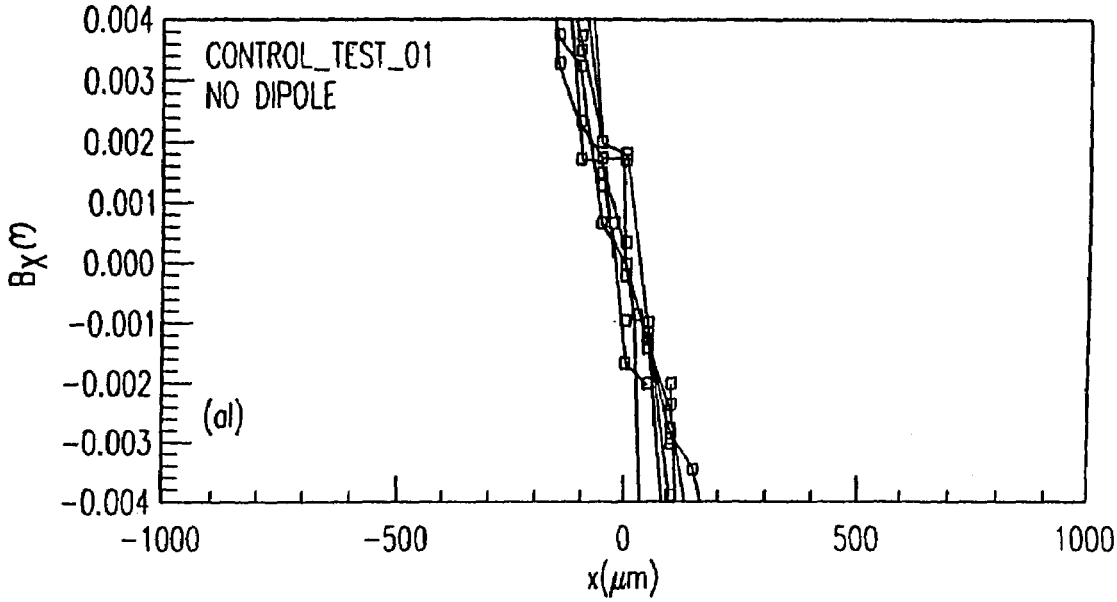
FIGS. 5A-5C show extracted horizontal components (Bx) of the magnetic flux in FIG. 4.
Figure 5B:
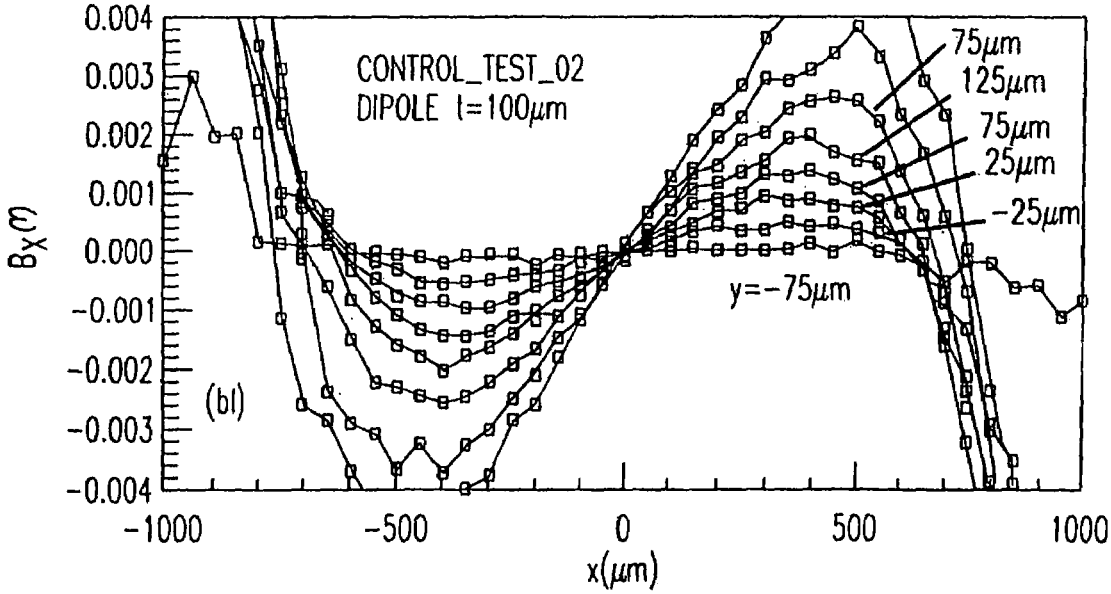
Figure 5C:
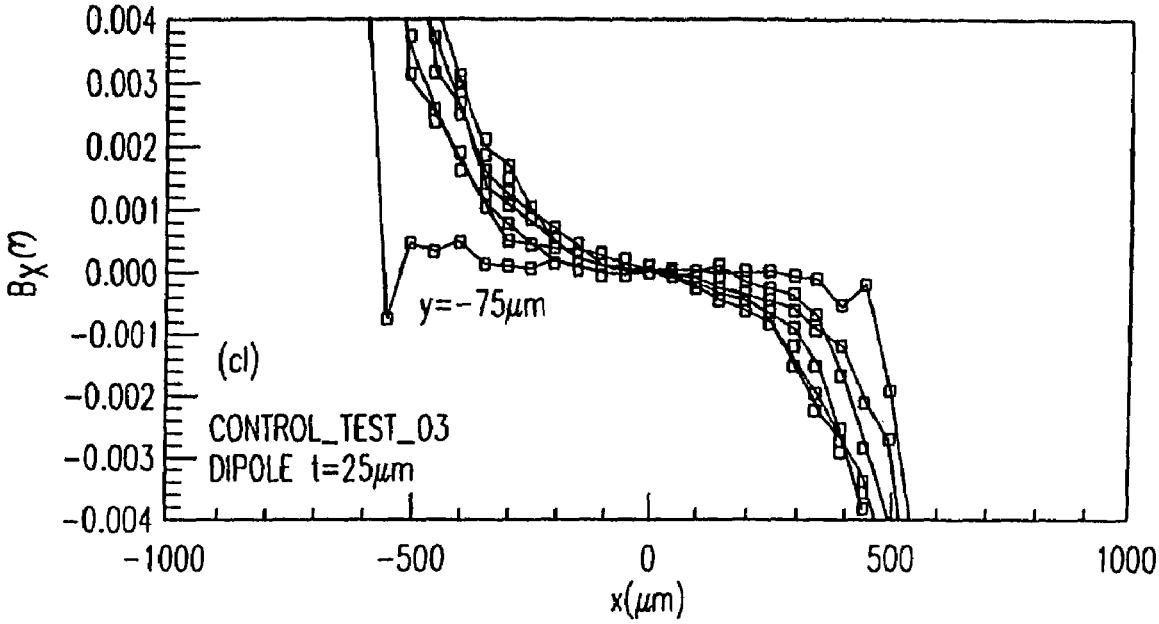

FIGS. 5A-C show the extracted horizontal components (Bx) of the magnetic flux along cut-lines at various heights (y=−75 mm, −25 mm, 25 mm . . . ). From the top to bottom (a1-b1-c1), the right-hand figures correspond to case (a) a single permanent magnet, (b) a permanent magnet with a high-permeability magnetic layer (thickness t=100 mm), and another case where the high-permeability magnetic layer thickness is t=25 mm. In (a1) without the high-permeability magnetic layer, we can see that Bx increases rapidly away from the center. In (b1), Bx is reduced from (a1) due to the use of the high-permeability magnetic layer. A thinner high-m layer (c1) is less effective as the thicker one (b1).

This property, that the magnetic field is normal to the boundary surface of a high-permeability material, and the placement of the cantilever (soft magnetic) with its horizontal plane parallel to the surface of the high-permeability material, can be used in many different configurations to relax the permanent magnet alignment requirement.

Figure 6A:
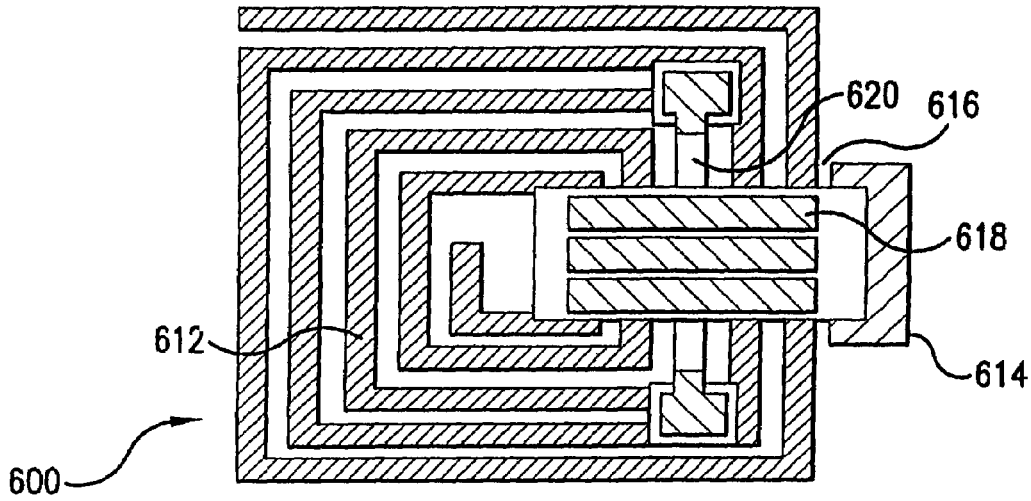
FIGS. 6A and 6B show a top view and a side view, respectively, of a micromagnetic latching switch 600 with relaxed permanent magnet alignment according to an aspect of the present invention.
Figure 6B:
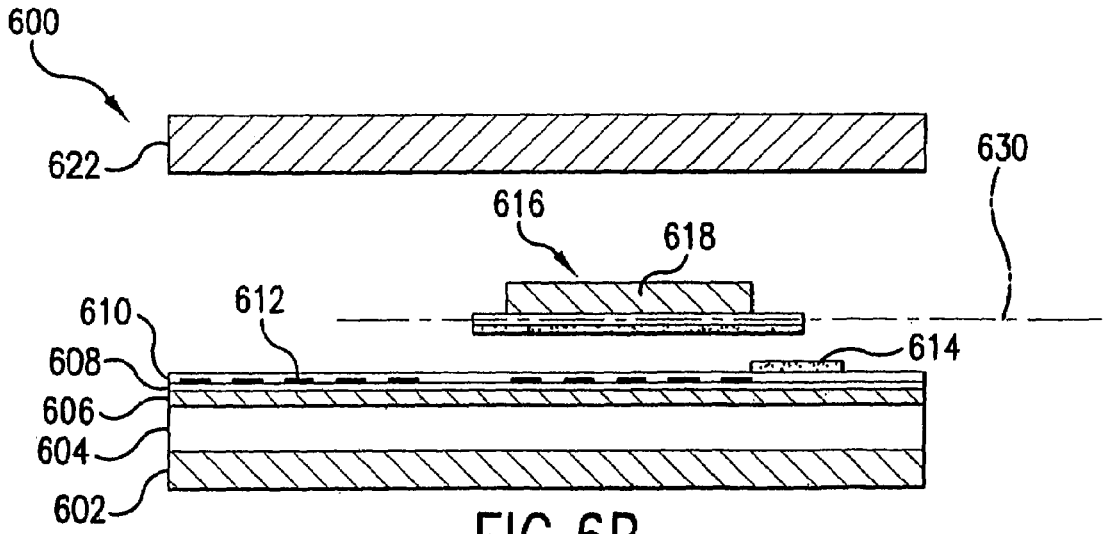

FIGS. 6A and 6B show a top view and a side view, respectively, of a micromagnetic latching switch 600 with relaxed permanent magnet alignment according to an aspect the present invention. In this embodiment, two high-permeability magnetic layers are used to help the magnetic alignment in making the micromagnetic latching switch. The switch comprises the following basic elements: first high-permeability magnetic layer 602, substrate 604, second high-permeability magnetic layer 606, dielectric layers 608 and 610, a spiral coil 612, bottom conductor 614, cantilever assembly 616 (with at least a soft magnetic layer 618 and other conducting and/or supporting torsion spring 620), and a top permanent magnetic layer 622 with a vertical magnetization orientation. Preferably, the surfaces of the permanent magnet 622 and the high-permeability magnetic layers 602 and 606 are all parallel to the horizontal plane 630 of the cantilever 616 so that the horizontal component of the magnetic field produced by 622 is greatly reduced near cantilever 616. Alternatively, a single soft magnetic layer (602 or 606) can be used.

Figure 7:
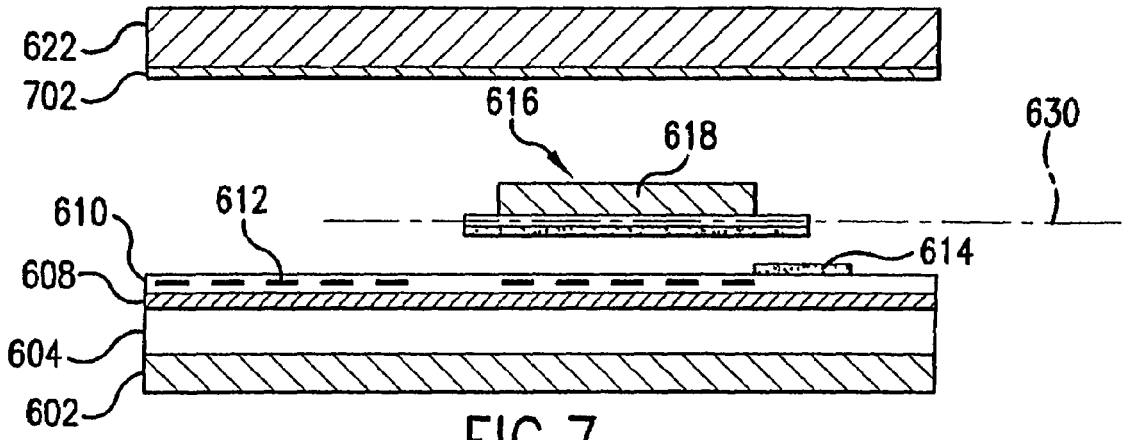
FIGS. 7 and 8 show further embodiments of the micromagnetic latching switch according to the present invention.

FIG. 7 shows another embodiment of the micromagnetic latching switch. In this embodiment, two high-permeability magnetic layers are used to help the magnetic alignment in making the micromagnetic latching switch. The switch comprises the similar basic elements as shown in FIG. 6. What differs in this embodiment from that of FIG. 6 is that the second high-permeability magnetic layer 702 is placed just below the top permanent magnet 622. Again, preferably, the surfaces of the permanent magnet 622 and the high-permeability magnetic layers 602 and 702 are all parallel to the horizontal plane 630 of the cantilever 616 so that the horizontal component of the magnetic field produced by 622 is greatly reduced near cantilever 616.

Figure 8:
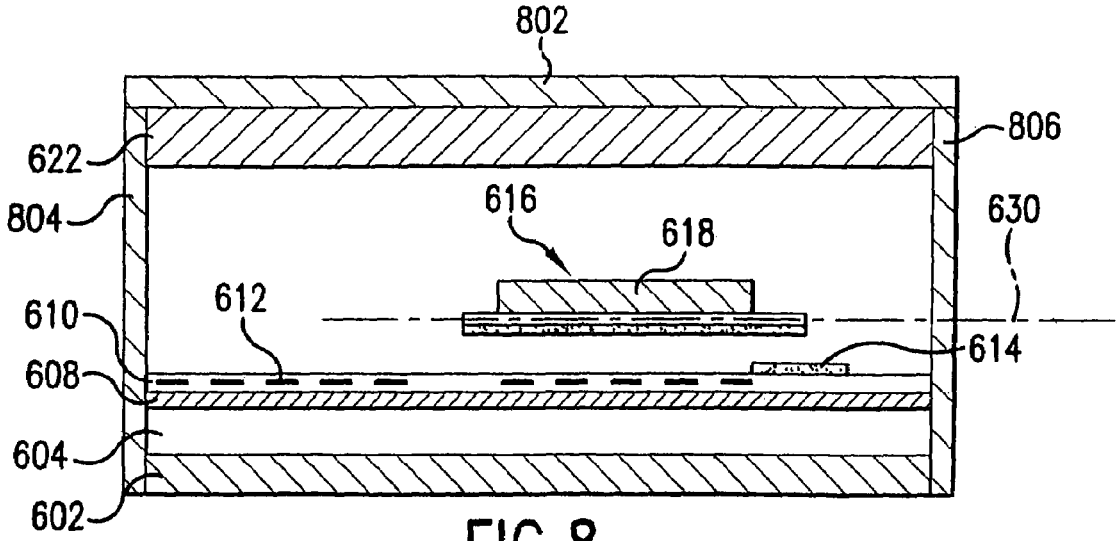

FIG. 8 shows another embodiment of the micromagnetic latching switch. In this embodiment, several high-permeability magnetic layers 602, 802, 804 and 806 are placed around the permanent magnet 622 and the cantilever switch in a package to form a magnetic loop. The bottom high-permeability magnetic layer 602 helps to reduce the horizontal field component near cantilever 616, and the layers 802, 804 and 806 screens the external field and improve the internal magnetic field strength.

The above cases are provided as examples to illustrate the use of high-permeability magnetic materials in combination with permanent magnets to produce magnetic fields perpendicular to the horizontal plane of the cantilever of the micromagnetic latching switches. Different variations (multiple layers, different placements, etc.) can be designed based on this principle to accomplish the goal of relaxing the alignment of the permanent magnet with the cantilever to make the switch bistable (latching) and easy (low current) to switch from one state to the other.

In another embodiment pf the present invention, the switch system comprises micromagnetic cantilevers, electromagnets (S-shape or single-line coils), permanent magnetic and soft magnetic layer in parallel to provide an approximate uniform magnetic field distribution, single-pole double-throw (SPDT) schemes, and transmission line structures suitable for radio frequency signal transmissions.

Figure 9A:
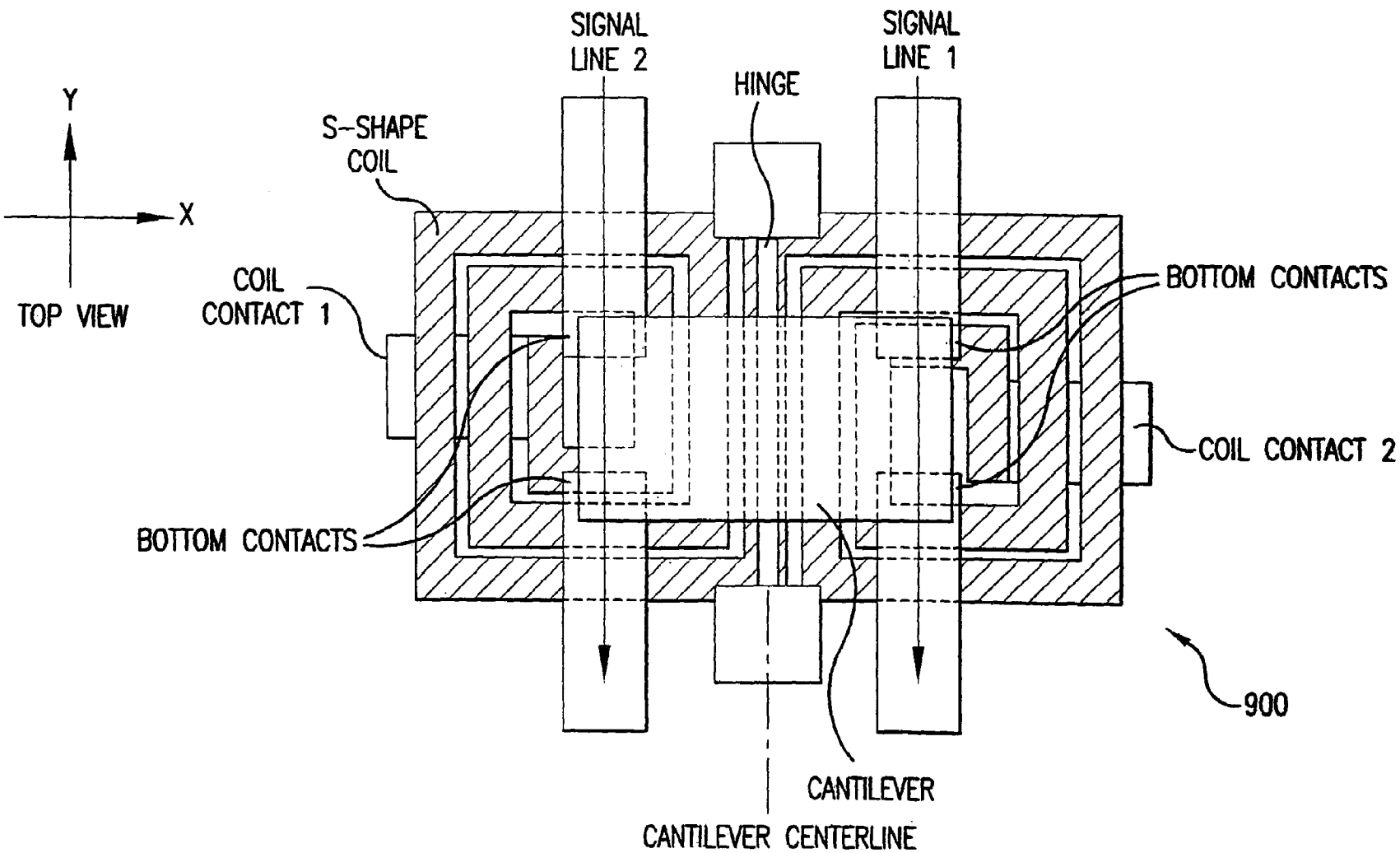
FIGS. 9A and 9B show a top view and a side view, respectively, of a micromagnetic latching switch with additional features of the present invention.
Figure 9B:
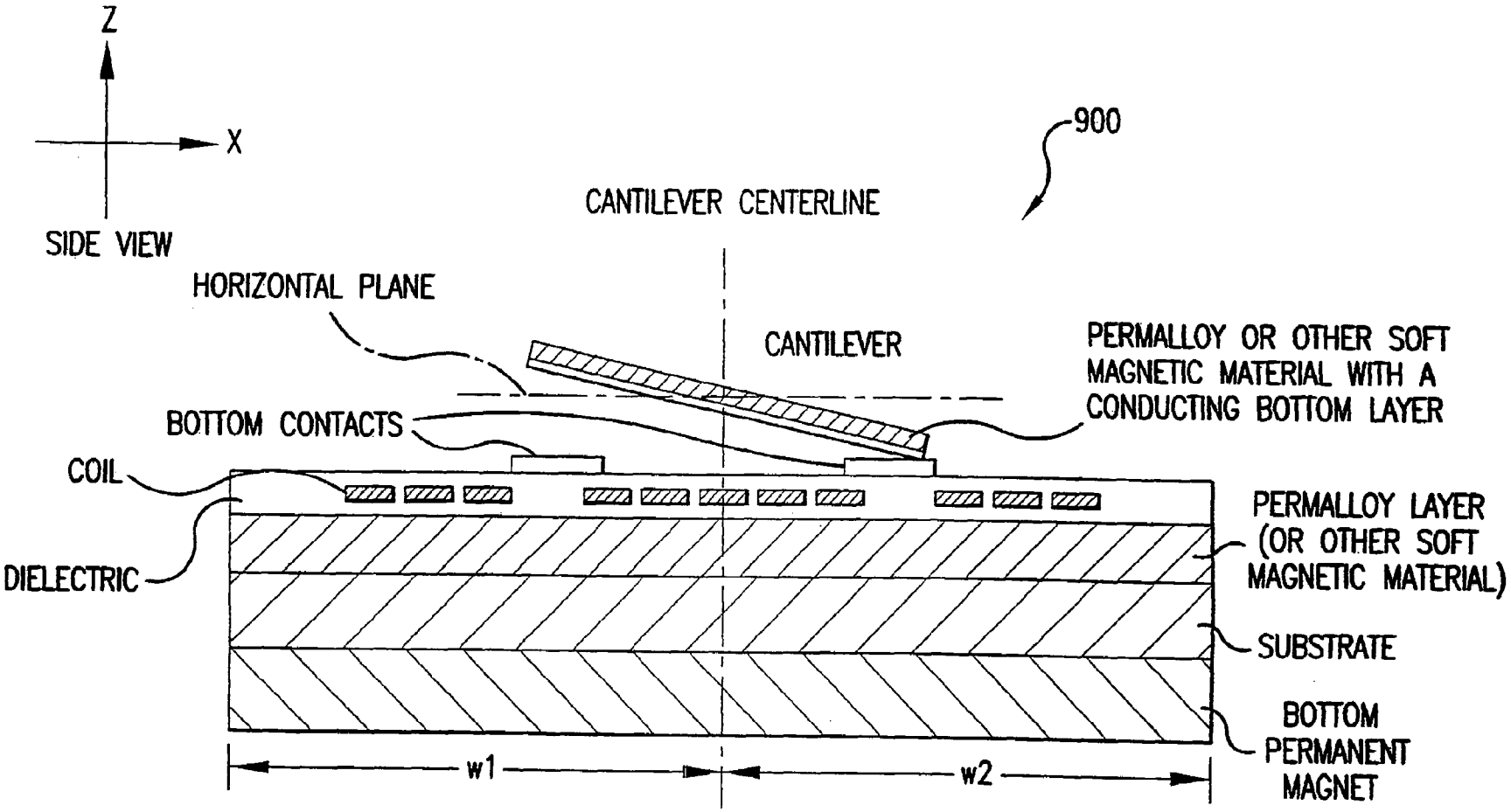

FIGS. 9A and 9B shows a top view and a side view, respectively, of a micromagnetic latching switch with additional features of the present invention. The switch 900 comprises the following basic elements: a cantilever made of soft magnetic material (e.g., permalloy) and a conducting layer, cantilever-supporting hinges (torsion spring), bottom contacts that serve as the signal lines, an "S-shape" planar conducting coil, a permalloy layer (or other soft magnetic material) on the substrate (which is permalloy silicon, GaAs, glass, etc.), and a bottom permanent magnet (e.g., Neodymium) attached to the bottom of the substrate. The magnet can be placed or fabricated directly on the substrate. The magnetization orientation of the magnet is either along +Z or along −Z. Due to the soft magnetic material's nature of high permeability, the magnetic field near the permalloy top surface is self-aligned parallel to the z-axis (or approximately perpendicular to the permalloy layer surface). This self-aligned field is needed for holding the cantilever in either on or off state. The whole device is housed in a suitable package (not shown) with proper sealing and electrical contact leads.

For the best performance, the cantilever centerline (which may not be the same as the hinge line) should be located approximately near the center of the magnet, i.e., the two distances from the edge (w1 and w2) are approximately equal. However, the cantilever centerline can also be located away from the center of the magnets and the device will still be functional. The S-shape coil produces the switching magnetic field to switch the cantilever from one state to the other by applying positive or negative current pulses into the coil. In the figure, the effective coil turn number under the cantilever is 5. However, the coil turn number n can be any arbitrary positive integer number ($1 \leqq n \leqq \infty$). When the turn number is one, it means there is just a single switching metal line under the cantilever. This is very useful design when the device size is scaled down. In addition, multilayer coil can also be used to strengthen the switching capability. This can be done by adding the successive coil layers on top of the other layer(s). Coil layers can be spaced by the in-between insulator and connected through the conducting vias.

The permanent magnetic field holds (latches) the cantilever to either state. When the cantilever toggles to the right, the cantilever's bottom conductor (e.g., Au) touches the bottom contacts and connects the signal line 1. In this case, the signal line 2 is disconnected. On the other hand, when the cantilever toggles to the left, the signal line 2 is connected and signal line 1 is disconnected. It forms a SPDT latching switch. Although in the figure, the widths of the magnet and permalloy layer on substrate are same, in reality, they can be different. The width of the magnet can either be larger or smaller than the width of the permalloy layer.

Application Specific Uses of Latching Micromagnetic Switches

Many goods comprising electrical or electronic-related devices employ discrete components made of conductive traces disposed on some form of a substrate. The latching micromagnetic switches 100 of the present invention can be used to change various characteristics of such conductive traces, or simply connect or couple them together. By way of example, but not limitation, the latching micromagnetic switches 100 of the present invention can be used to adjust, select, switch, couple, or otherwise reconfigurable (e.g., digitally tune) many types of devices or conductive traces. For purposes of this description and the accompanying claims, the term "conductive trace" means any metal, metal alloy, semiconductor (e.g., doped or not doped) or other conductive material formed or otherwise patterned on a substrate, as would also become apparent to a person skilled in the art based on the teachings herein. The terms "microstrip" and conductive trace are used interchangeably herein.

General Apparatus Using the Switches

Figure 10:
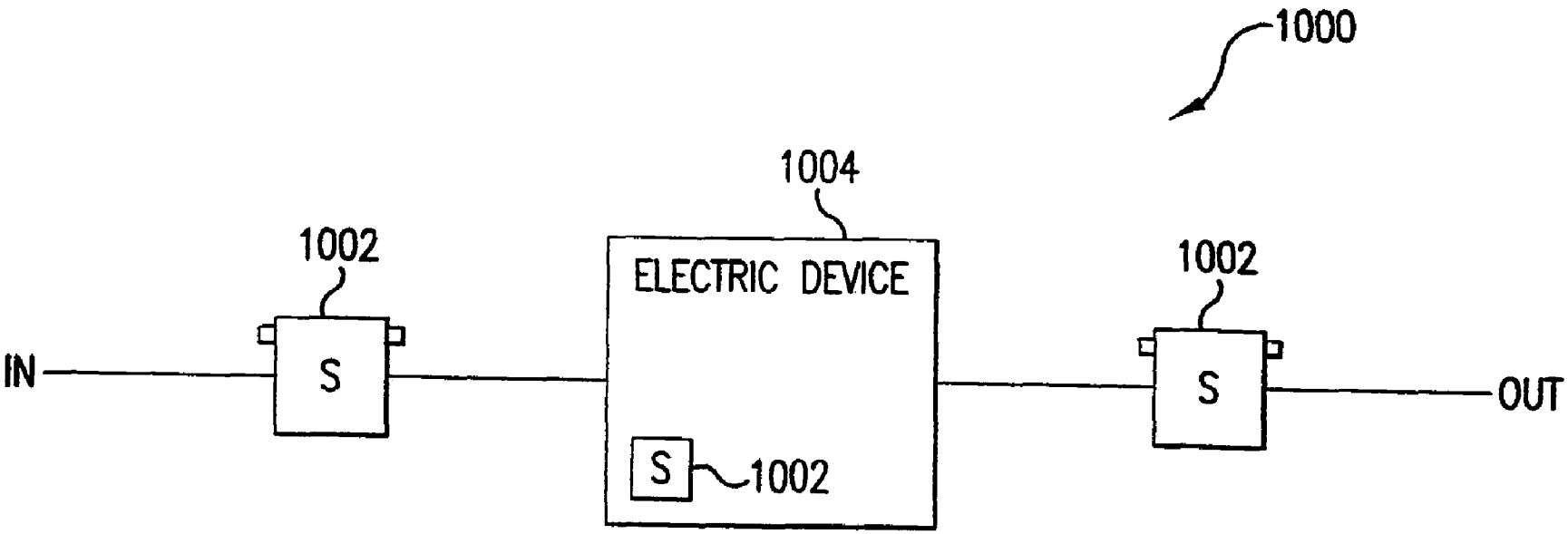
FIG. 10 illustrates an apparatus including a device and a latching micromagnetic switch according to embodiments of the present invention.

FIG. 10 illustrates an apparatus 1000 (or portion of an apparatus) that uses one or more latching micromagnetic switches 1002, according to embodiments of the present invention. Throughout the specification, the use of "switch" or "switches" can be any one of the above-described switches in FIGS. 1-9B or any of the switches described in related U.S. application Ser. No. 10/051,447, entitled "MICRO-MAGNETIC LATCHING SWITCH WITH RELAXED PERMANENT MAGNET ALIGNMENT REQUIREMENTS," filed Jan. 18, 2002, which is incorporated herein by reference in its entirety. The apparatus 1000 also includes an electrical device 1004 (e.g., a circuit(s), a filter(s), a filter system, an antenna(s), a transceiver(s), etc.) coupled to one or more switches 100. In some embodiments switch 1002 can be coupled adjacent an input, an output, or both. In other embodiments, switch 1002 can be in electrical device 1004 and not at an input and an output, or can be in electrical device 1004, adjacent an input, adjacent an output, or any combination thereof. In some embodiments a device can be retrofitted to be coupled to and controlled by switches 1002, while in other embodiments the electric device 1004 and switches 1002 can be integrated on the same substrate. Switches 1002 control energy flow through electrical device 1004, while providing the benefits of using MEMs technology as described above.

Filter Apparatus Using the Switches

Currently there are a number of different wireless communications protocols in use (GSM, CDMA, TDMA, European GSM, GPS and G3 to name a few) that make it impractical to design and manufacture a single wireless handset (or other wireless communications device) that is compatible with more than perhaps one or two of these different protocols. The electronic components that makeup a two-way radio, such as filters, oscillators, power amplifiers and antennas must typically be designed to operate over a very narrow and specific frequency range in order to achieve the required level of performance. In order to produce a multimode handset, several similar components must be used, each of which is allocated to a different mode. This approach is costly, bulky and complicated. Therefore, switches can eliminate much of this redundancy by providing a way of producing sufficiently high quality reconfigurable RF components that cannot be practically implemented using other more conventional design approaches. Switches are uniquely suited for this purpose because they have a very high bandwidth, high linearity, low insertion loss, high isolation, require a small chip area and can be produced cost effectively. Herein described are several methods of using latching magnetic MEMS switches to produce a reconfigurable bandpass filter. A bandpass filter was chosen as an example because they are used extensively in cell phones and wireless local area networks (LANs), but it should be noted that the following concepts can equally well be applied to various order lowpass, high-pass and band rejection filters, and the like.

Figure 11:
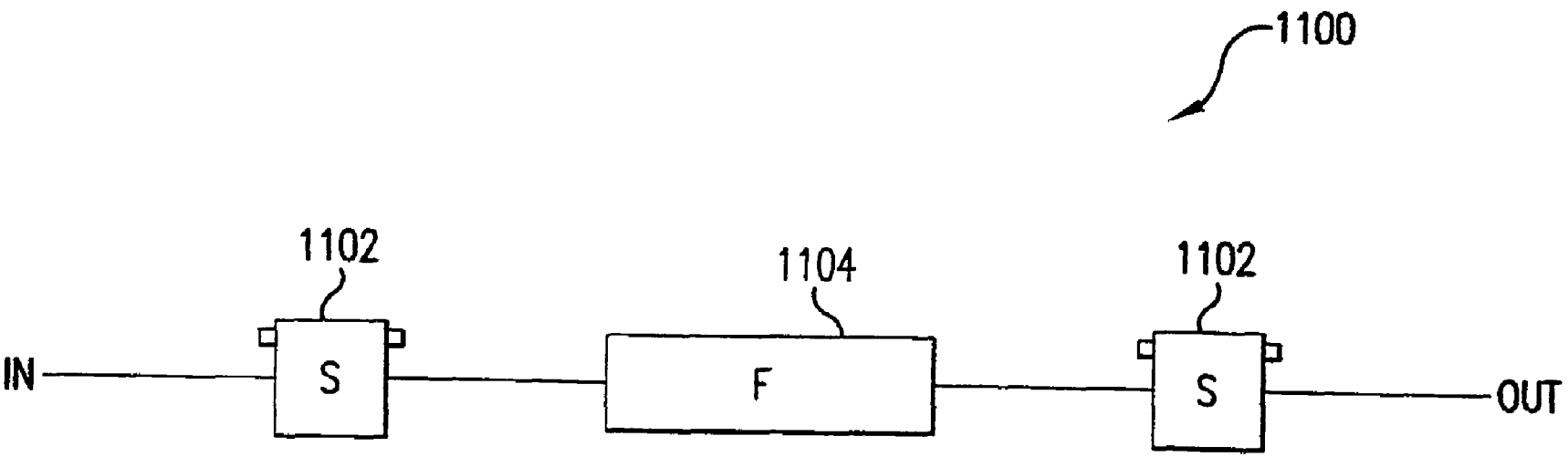
FIGS. 11-12 illustrate a portion of an apparatus including a filter and two latching micromagnetic switches according to embodiments of the present invention.

FIG. 11 illustrates a portion of an apparatus 1100 according to embodiments of the present invention. Apparatus 1100 includes a switch (S) 1102 at an input, a filter (F) 1104, and switch 1106 at an output. No energy flows through this apparatus 1100 unless both switches 1102 and 1106 are open, thus turning the filter 11000N and OFF.

Figure 12:
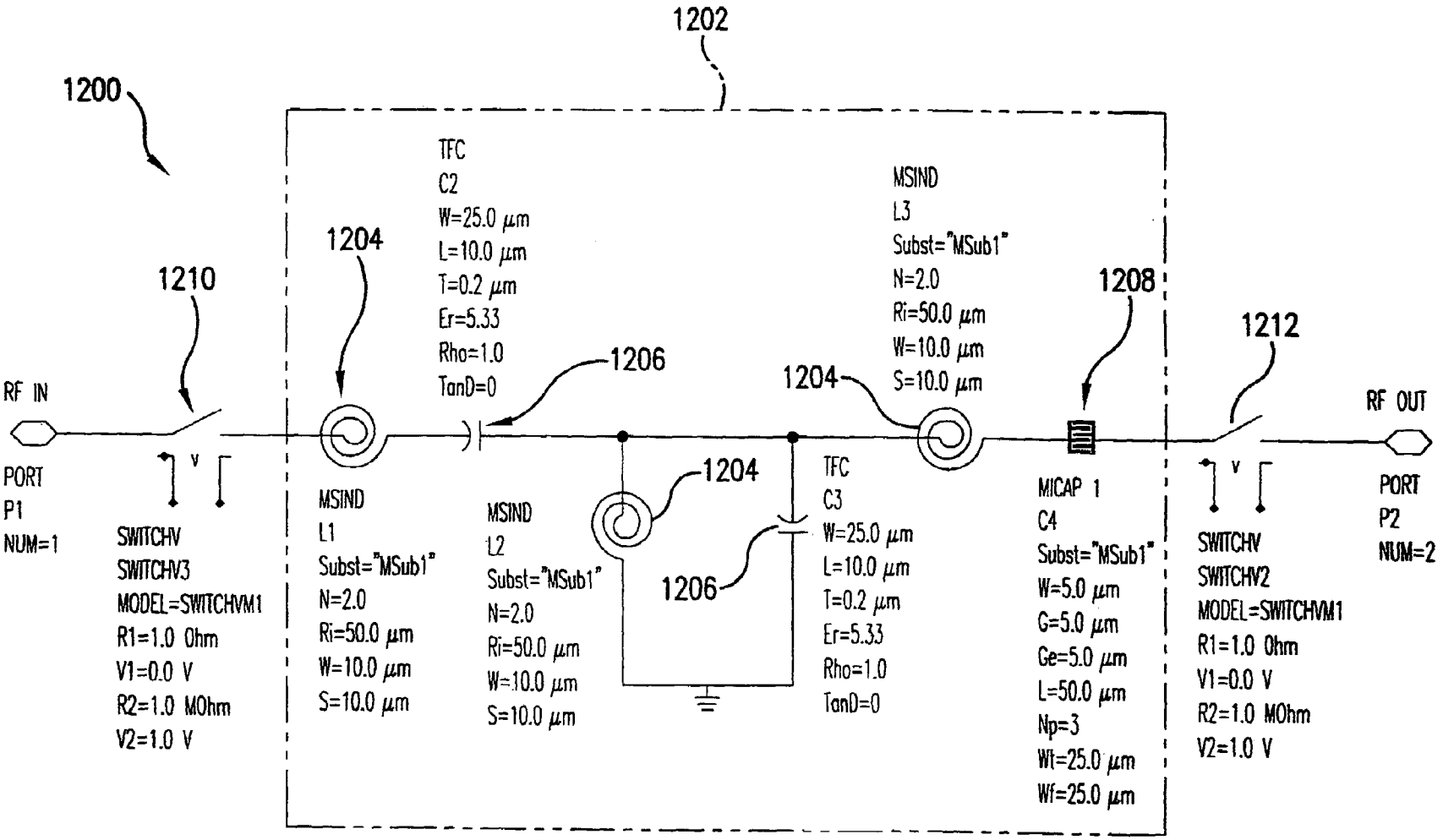

FIG. 12 shows close-up view of a portion of an apparatus 1200 according to an embodiment of the present invention. Apparatus 1200 includes a filter 1202 composed of "lumped" or discrete inductors 1204 and capacitors 1206 and 1208. Specifically, planar spiral inductors 1204 and two types of capacitors: a thin-film type 1206 and an interdigitated variety 1208. These two different types of capacitors are only shown to demonstrate two different architectures, and not to limit the invention. These lumped components have an advantage of producing a filter 1202 with a very high-Q or sharply defined resonant frequency (which is a significant figure of merit for filters), but has the disadvantage of not being the most compact design in terms of chip area and becoming inoperable at very high microwave frequencies. Again, switches 1210 and 1212 control energy flow to turn the filter 1202 ON and OFF.

Figure 13A:
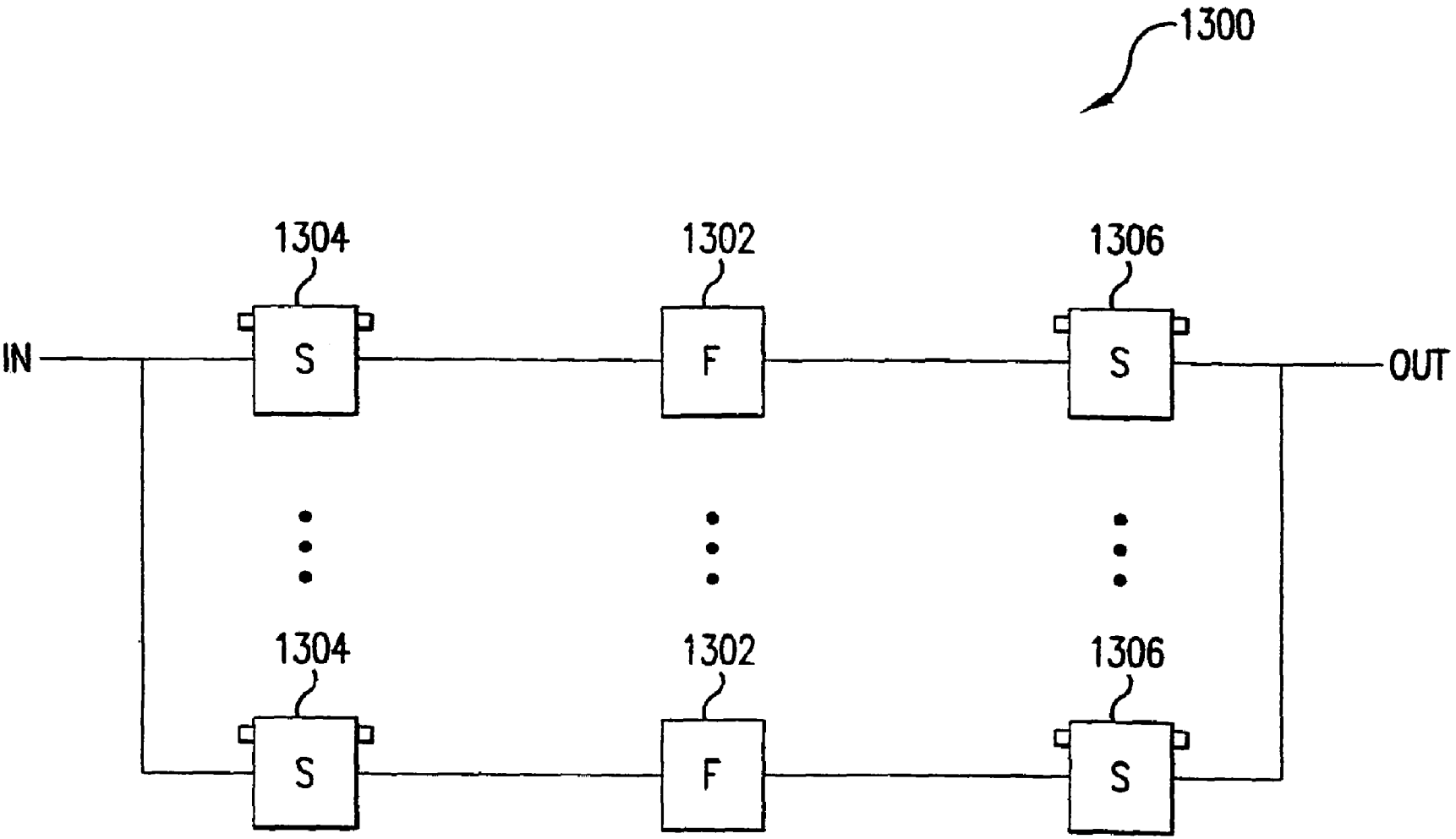
FIGS. 13A, 13B, 14A, 14B, and 15 illustrate a portion of an apparatus including a plurality of filters and a plurality of latching micromagnetic switches according to embodiments of the present invention.

FIG. 13A illustrates a portion of an apparatus 1300 according to embodiments of the present invention. Apparatus 1300 includes a plurality of filters 1302 that are controlled by a pair of switches 1304 and 1306. Throughout the specification, the use of "filter" or "filters" can be an actual filter circuit or branches of a large filter (not shown). This apparatus 1300 can be a telephone, as described above, that has multiple frequency bands, and thus multiple band pass band filters 1302. Switches 1304 and 1306 control which filter 1302 is operating, thus controlling which frequency is being used by the apparatus 1300.

Figure 13B:
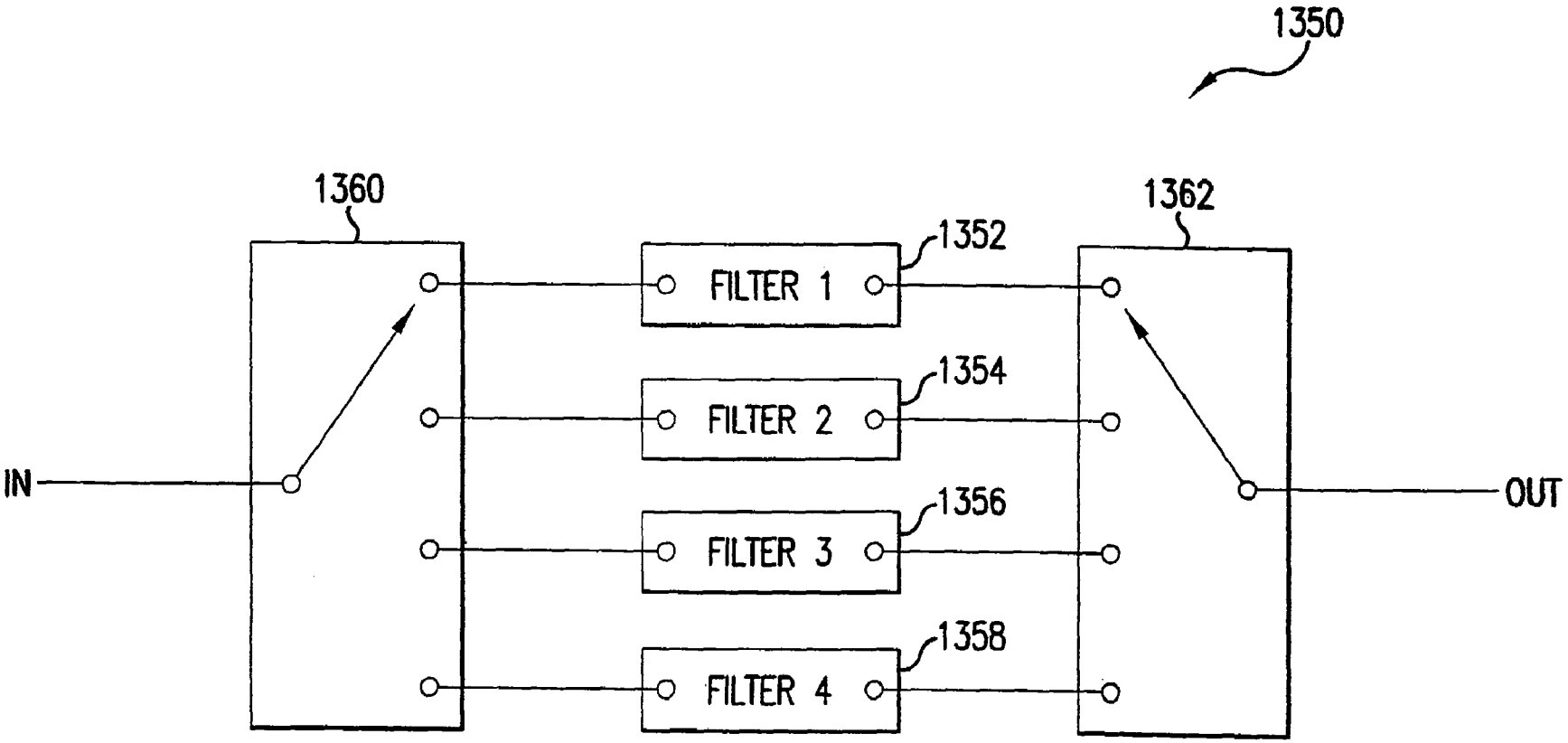

FIG. 13B illustrates a circuit diagram of a portion of an apparatus 1350 according to embodiments of the present invention. Apparatus 1350 includes four filters 1352-1358 coupled between two switches 1360 and 1362. The four filters 1352-1358 can be either lumped types filters (FIG. 14) or any other type of filters, such as SAW filters, BAW filters, etc. The switches 1360 and 1362 can be either single-pole, four-throw switches (SP4T) or equivalently a 1×4 matrix switch configured from one or more latching micromagnetic switches in accordance with embodiments of the present invention. For example, the switches 1360 and 1362 can include four latching micromagnetic switches controlled by a single signal to turn only one latching micromagnetic switch OFF and ON at a time, such that only one filter 1352-1358 is operating at a time. It is to be appreciated that any "m" (m is any positive integer) filters can be controlled by switches 1360 and 1362, thus the switches may be single-pole, "m"-throw switches or 1×m matrix switches.

Figure 14A:
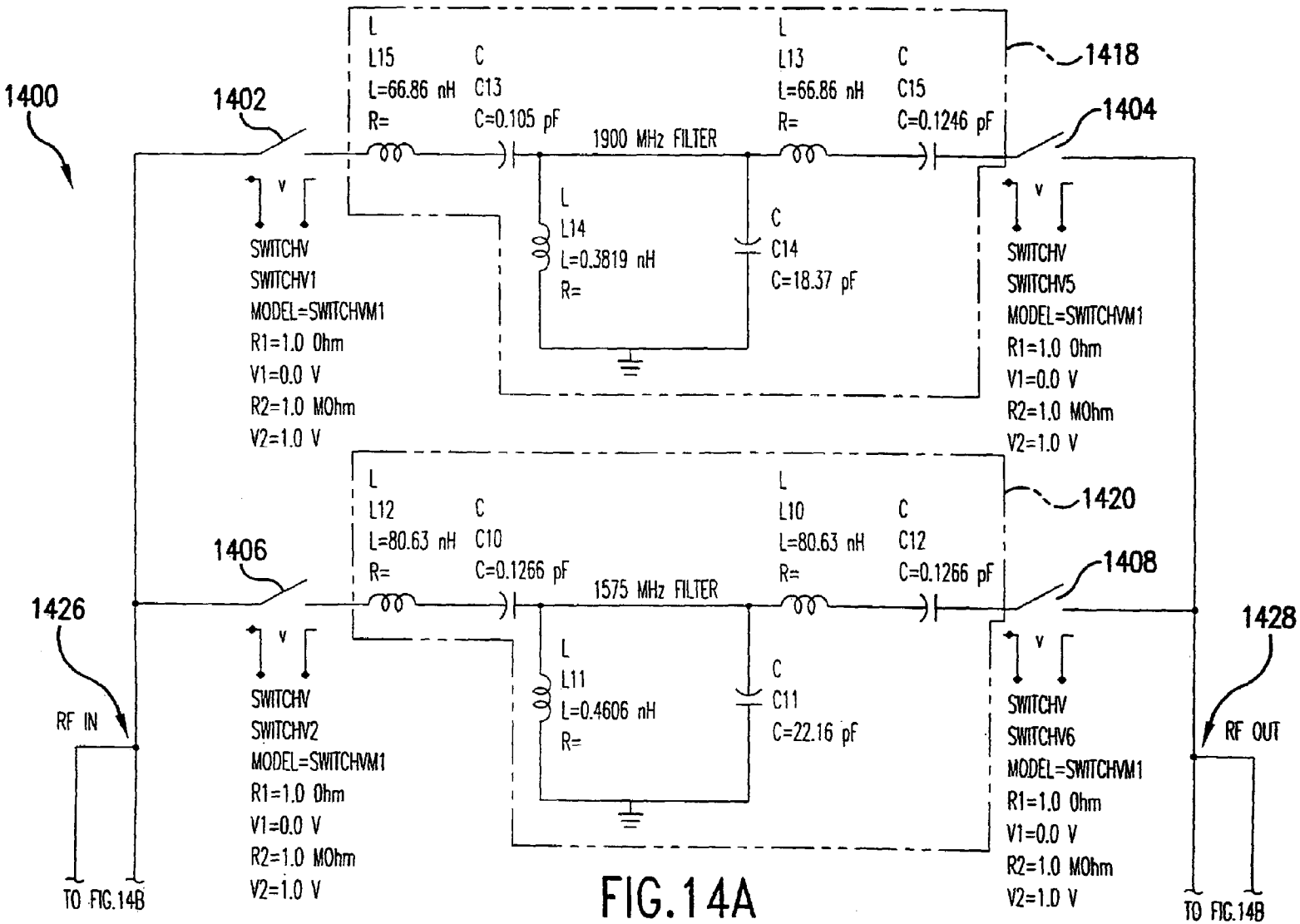
Figure 14B:
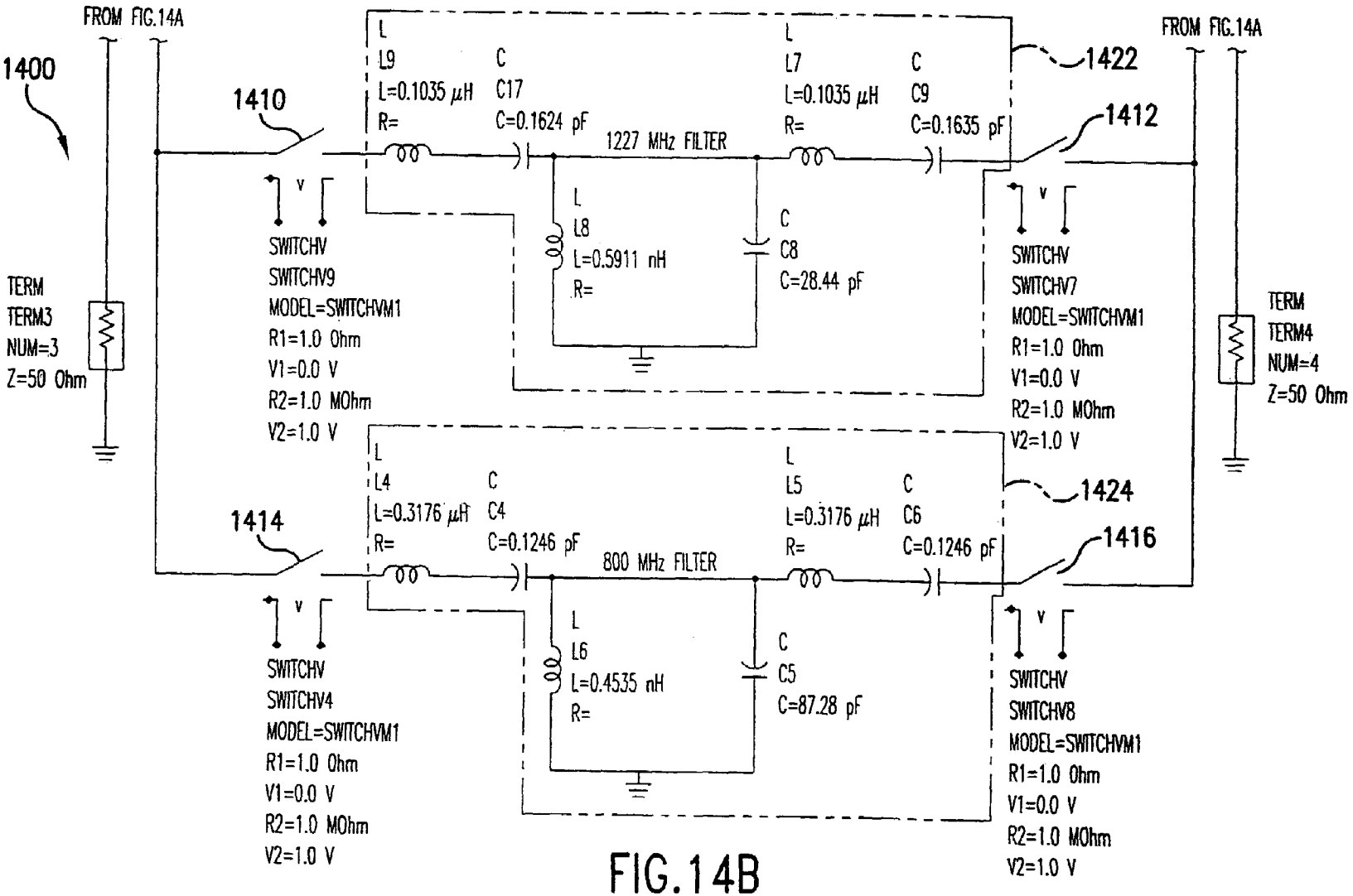

FIGS. 14A and 14B are a circuit diagrams illustrating a portion of an apparatus 1400 according to embodiments of the present invention. Apparatus 1400 includes a reconfigurable bandpass filter design that uses magnetic latching MEMS switches 1402-1416 to select any combination of four different frequency passbands according to embodiments of the present invention. A large filter comprises four different small filters or "branches" 1418-1424, each of which is an independent bandpass filter "tuned" to a different and specific frequency. For this example, a third order equal-ripple filer design is shown. The individual lumped element values (for the capacitors and inductors) are given in the figure as exemplary values. By opening and closing the appropriate MEMS switches 1402-1416 the RF signal is directed from the "RF in" port 1426 through the appropriate filter(s) 1418-1424 and to the "RF out" port 1428. Switches 1402 and 1404 are either both open or both closed. Similarly for 1406 and 1408 are either both open or both closed, and likewise for pairs 1410 and 1412 and pairs 1416 and 1418. Using this configuration, four separate filters 1418-1424 are replaced by a single switchable larger filter, which can considerably reduce the overall number of components in a multi-band cell phone (not shown). In other embodiments, any number of branches or filter elements can be accommodated.

Figure 15:
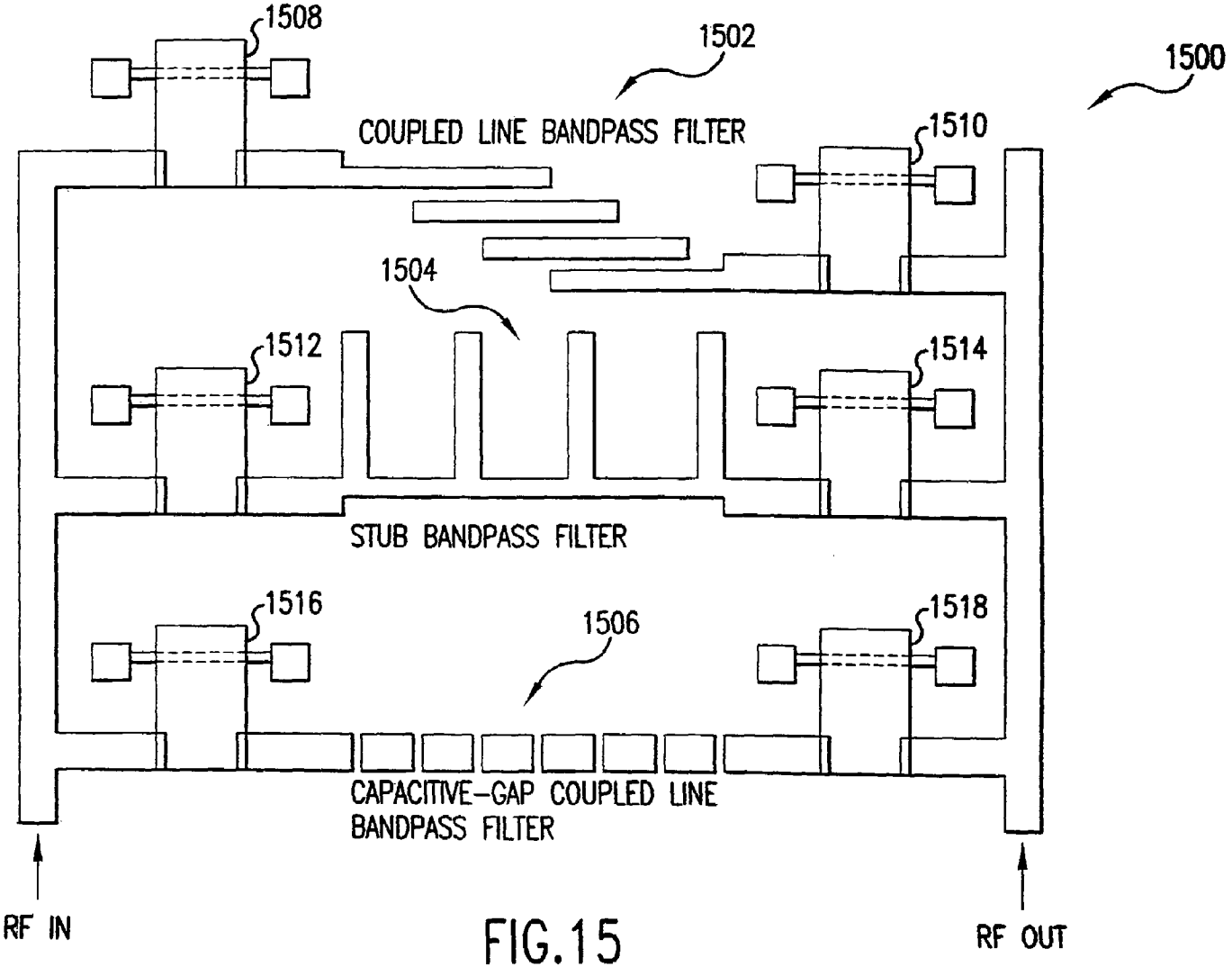

FIG. 15 illustrates a portion of an apparatus 1500 according to embodiments of the present invention. Apparatus 1500 is based on a distributed microstrip design, rather than the lumped (discrete) approach described in FIG. 14. Similar to the design shown in FIG. 14, the distributed microstrip reconfigurable large filter consists of three sub-filter "branches" or filters 1502-1506 that are selected using latching magnetic MEMS switches 1508-1518. However, the microstrip architecture relies on appropriately designed sections of transmission lines to produce the required inductance and capacitance values needed to synthesize the large filter. Although there are a variety of design approaches that can be used to accomplish this, three implementations of distributed bandpass filters are shown according to embodiments of the present invention. Specifically, a coupled line architecture 1506, a stub filter 1504, and a capacitive-gap coupled line bandpass filter 1502. These distributed approaches have the advantages of compactness and simplicity of fabrication, and good performance at high frequencies, but lack the high-Q performance of the discrete design.

It should be further noted that the concept of reconfigurablity of RF components using latching magnetic MEMS components can be further extended to envision structures such as reconfigurable inductors, where a "chain" of inductors is connected in series using MEMS switches. The series connection of several small inductors would yield the sum total inductance of all the small inductors additively. A "tunable" inductor could thus be constructed. Similarly, a parallel "chain" of capacitors could be produced in the identical way.

Antenna Apparatus Using the Switches

Figure 16:
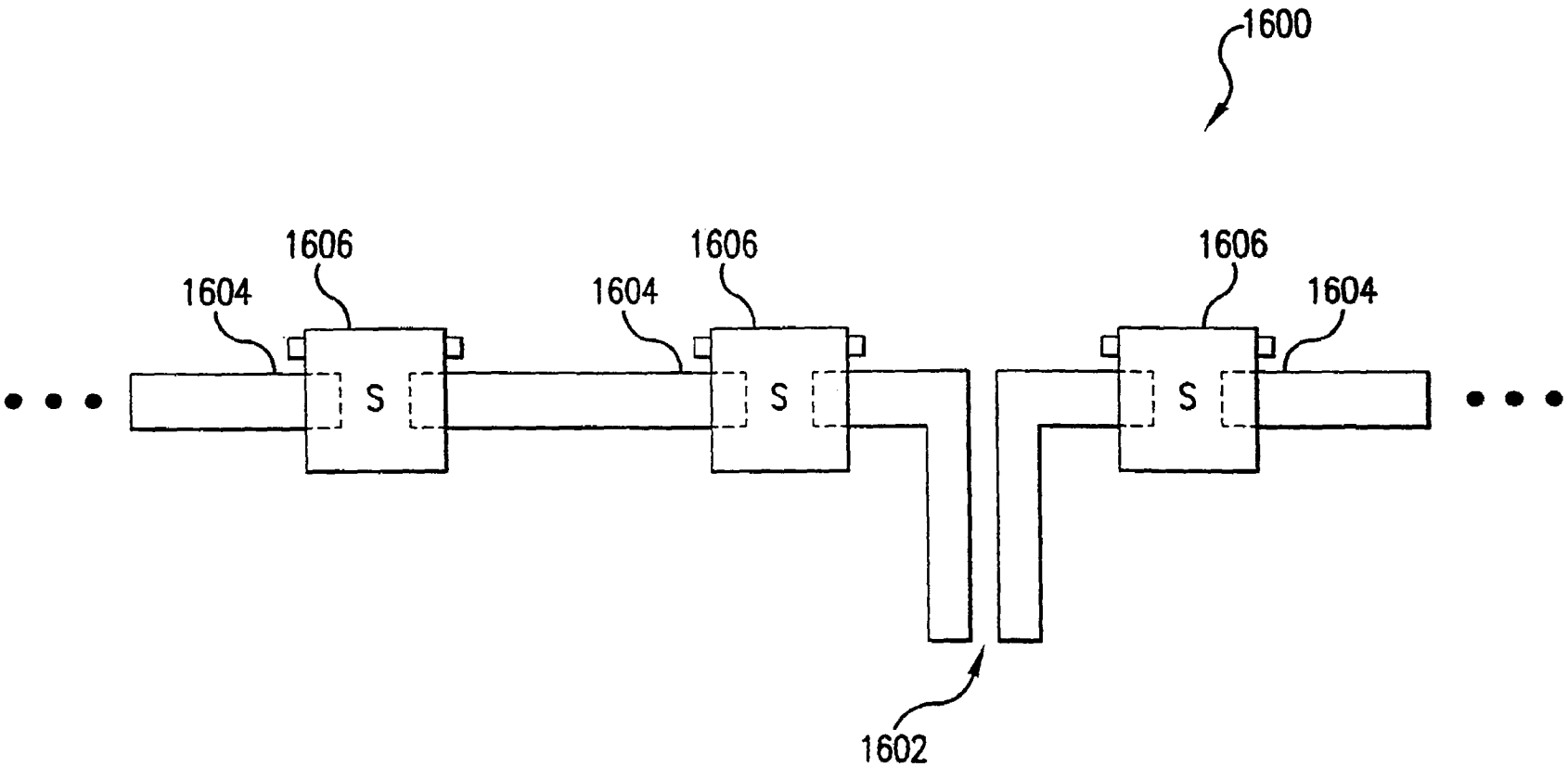
FIG. 16 illustrates a portion of an apparatus including an antenna with multiple conductive traces and multiple latching micromagnetic switches according to embodiments of the present invention.

FIG. 16 illustrate an apparatus 1600 having conductive traces. A strip or microstrip dipole antenna 1602 is formed on a substrate (not shown). Additional conductive traces 1604 can be added to tune the antenna 1602 using latching micromagnetic switches 1606. Alternatively, additional conductive trace elements 1604 of various shapes and sizes can be added using latching micromagnetic switches 1606. Phased-array antennas can also be implemented in this manner. In yet another antenna application, the cantilever of a latching micromagnetic switch can comprise an output horn portion of an adjustable antenna.

Transceiver Apparatus Using the Switches

Figure 17:
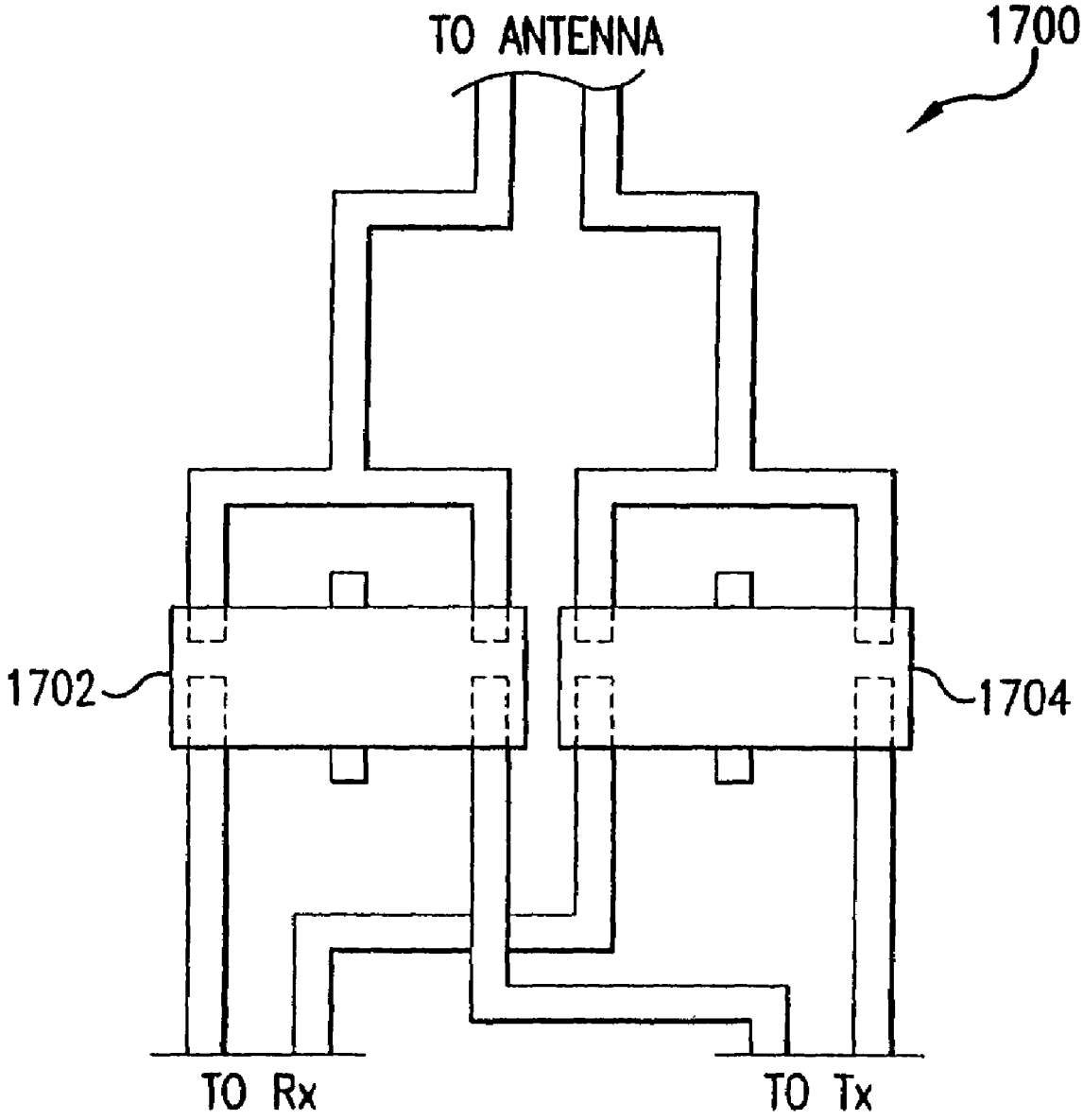
FIG. 17 illustrates a portion of an apparatus including a transceiver and antenna coupled via two latching micromagnetic switches according to embodiments of the present invention.

FIG. 17 illustrates a portion of an apparatus 1700 according to embodiments of the present invention. Apparatus 1700 can be a transceiver in which latching micromagnetic switches 1702 and 1704 can be used to switch coupling of an antenna or antenna array (not shown) between a transmit circuit (not shown) and a receive circuit (not shown). This is accomplished by having two latching micromagnetic switches 1702 and 1704 coupling a receiver (not shown) or a transmitter (not shown) to an antenna (not shown).

Power Control

Figure 18:
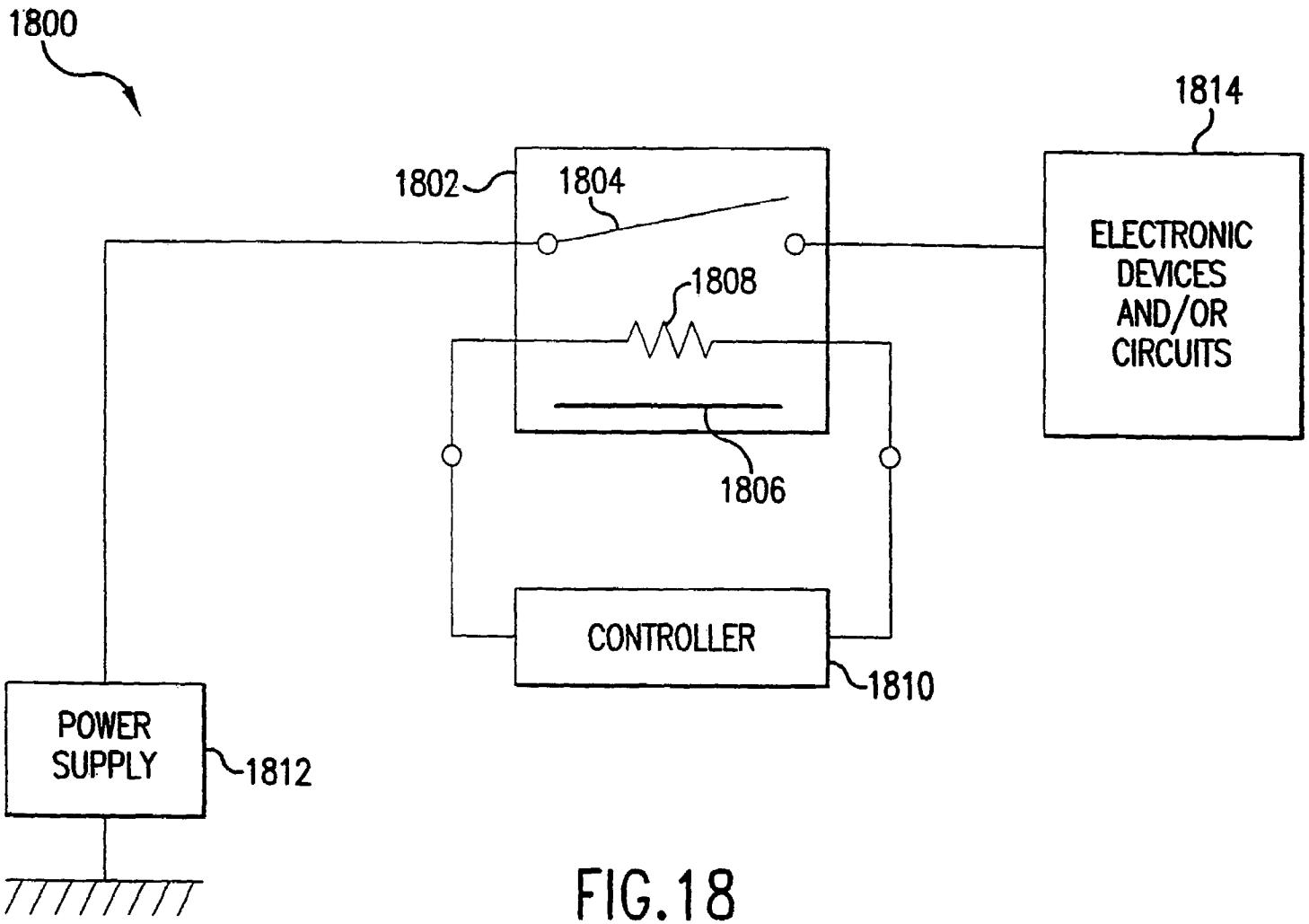
FIG. 18 illustrates a portion of system using a micromagnetic switch to control power supply to electronic devices and/or circuits.

FIG. 18 illustrates a schematic drawing of an apparatus 1800 according to embodiments of the present invention. Apparatus 1800 includes a latching micromagnetic switch 1802 having a cantilever 1804, a permanent magnet 1806, and a coil 1808. The coil is controlled by a controller 1810 to move the cantilever between two stable positions. The switch 1802 is coupled between a power supply 1812 and an electrical devices and/or circuits (electronic device) 1814. The switch 1802 is used to control the flow of power from the power supply 1812 to the electronic devices and/or circuits 1814. When the power supply 1812 is needed for the electronic device 1814, a short current pulse through the coil 1808 in the switch 1802 turns the switch 1802 0N. In the ON state the power supply 1812 is connected to the electronic device 1814. When the power supply 1812 is not or nor longer needed, a short, opposite current pulse through the coil 1808 turns the switch 1802 OFF and disconnects the power supply 1812 from the electronic device 1814.

Other Applications of the Switches

Latching micromagnetic switches of the present invention can be used with conductive traces in many other applications as well. They can be employed as switching elements for digital components, such as multiplexers and de-multiplexers, phase shifters, delay lines, surface acoustic wave (SAW) devices, programable RF circuits, and tunable oscillators. For multiplexer and de-multiplexer applications, the latching micromagnetic switches can be used to redirect signals according to a desired mux or demux logic function. For phase shifters, delay lines, surface acoustic wave (SAW) devices, the latching micromagnetic switches can switch in or switch out additional elements of delay or phase, and in the case of a SAW add or subtract inter digitate finger elements as desired. For programable RF circuits, such as a tunable oscillator, the latching micromagnetic switches can be used to switch in or switch out components to change resonator(s) characteristics.

Similarly, conductive traces are used in integrated circuit couplers. The wavelength, impedance, or the like, of such couplers can be adjusted using latching micromagnetic switches.

Also, as discussed above, the latching micromagnetic switches can either be integrated on a same substrate as an electrical device being controlled or can be non-integrated and located on a separate substrate from the electrical device being controlled. This allows for pre-existing devices to use the switches, while also allowing for new devices to integrate the switches to reduce the size of the overall apparatus.

Other HighQ Switching Applications

Latching micromagnetic switches of the present invention can be used in high redundancy RF circuit applications to switch-in redundant components to replace failed components. Another area in which the latching micromagnetic switches of the present invention can be used is in RF switch arrays for a testing apparatus. Once a probe is connected to a device under test, various tests can be performed by switchably connecting various different test modules/circuits using an array of micromagnetic latches according to the present invention.

The latching micromagnetic switches of the present invention can be used in communications switch applications, such as in cross-point switches. Public switch network switches and private branch exchange switches can be implemented using cross-point switches comprising latching micromagnetic switches. Both optical-to-electrical-to-optical (OEO) and all optical cross-point switch can employ latching micromagnetic switches.

Repeaters exist for receiving EM (electromagnetic) information signals, optionally performing signal conditioning or processing (amplification, filtering, frequency translation, etc.) on the received signals, and re-transmitting the conditioned signals at same or different frequencies. Repeaters suffer from the disadvantage of being relatively expensive in terms of cost and power consumption. Conventional wireless communications circuitry is complex and has a large number of circuit parts. Higher part counts result in higher power consumption, which is undesirable, particularly in battery powered repeater units. A latching micromagnetic switch according to the present invention can reduce power consumption in such repeaters.

High sensitivity, low noise amplifiers can also benefit by incorporating latching micromagnetic switches. In this embodiment, a selectable number of output devices (e.g., transistors) can be used to adjust or optimize the amplifier output power. Gate and/or drain switching can be performed by latching micromagnetic switches to achieve a highQ, low noise signal.

Latching micromagnetic switches can also be used as switching elements in each pixel of an image projector. A dense array of mirrored cantilevered switches can be used to project bright light or filtered light of much higher intensity than permitted by conventional LCD projectors. The latching micromagnetic switches of the present invention can withstand switching speeds well in excess of the frequency required for image projection.

The low-power dissipation of the latching micromagnetic switches of the present invention can have benefits in power management and replay circuits in many fields. An example field is automotive applications, such as sensor switching and higher power switching using parallel latching micromagnetic switches.

Latching micromagnetic switches can be used in conjunction with a magnetic key to implement a reconfigurable relay lock. A key can be fabricated by arranging several to hundreds of miniature magnets in a physically, programmed array fashion. A cooperative lock mechanism to receive the key can be formed of an array of latching micromagnetic switches to read the programmed array of miniature magnets to unlock any manner of device, circuit or hardware component (e.g., a door). The key can be configured as a flat rectangular card, or can take-on a variety of physical shapes, as would also become apparent to a person skilled in the art. The lock can be digitally controlled to facilitate a programmable code.

Another security approach is to simply group switches together in a combinational logic circuit that would require actuation of the given combination of switches to pass a signal.

Other applications for latching micromagnetic switches include cable modems, TV tuners and smart circuit breakers.

CONCLUSION

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above. Finally, it should be emphasized that none of the elements or components described above are essential or critical to the practice of the invention, except as specifically noted herein.

What is claimed is:

1. A system comprising:

N branches including an electrical device in each, wherein N is a positive integer of 1 or greater;

a latching micromagnetic switch system that controls energy flow to each branch, such that only the electrical device in the branch connected to the latching micromagnetic switch system operates, the latching micromagnetic switch system having one or more latching micromagnetic switches, each including, a magnet proximate to a substrate, the magnet producing a first magnetic field;

a cantilever having a magnetic material and a longitudinal axis, the magnetic material making the cantilever sensitive to the first magnetic field, which is approximately perpendicular to the longitudinal axis, the cantilever rotating between a first and second state based on the first magnetic field producing a torque in the magnetic material of the cantilever that maintains the cantilever in one of the first and second states; and a conductor that conducts a current, the current induces a torque in the cantilever based on a second magnetic field, a component of the second magnetic field that is parallel to the longitudinal axis adjusts the direction of the torque produced by the first magnetic field in the magnetic material of the cantilever such that the conductor switches the cantilever between the first and second states;

wherein each of the N branches is coupled to first and second ones of the latching micromagnetic switches and wherein the first latching micromagnetic switch is located at an input of each of the N branches and the second latching micromagnetic switch is located at an output of the N branches.

2. The system of claim 1, wherein the N branches and the latching micromagnetic switch system are integrated on a same substrate.

3. The system of claim 1, wherein the N branches and the latching micromagnetic switch system are located on separate substrates and coupled together.

4. The system of claim 1, wherein the first and second latching micromagnetic switches are singe-pole, four-throw switches.

5. The system of claim 1, wherein the first and second latching micromagnetic switches are 1 by m matrix switches, wherein m is a positive integer.

6. The system of claim 1, wherein:

the electrical device is a transceiver; and the first latching micromagnetic switch controls a receive differential pair and the second latching micromagnetic switch controls a transmit differential pair.

7. The system of claim 1, wherein:

the first latching micromagnetic switch is a 1-input-N-output switch; and the second latching micromagnetic switch is a N-input-1-output switch.

8. The system of claim 1, wherein:

the electrical device is a filter passing various frequencies; and the first and the second latching micromagnetic switches control whether a signal is routed to the filter.

9. The system of claim 1, wherein the electrical device is a coupled line filter.

10. The system of claim 1, wherein the electrical device is a stub bandpass filter.

11. The system of claim 1, wherein the electrical device is a capacitive bandpass filter.

12. The system of claim 1, wherein the capacitive bandpass filter is a capacitive gap-coupled line bandpass filter.

13. The system of claim 1, wherein the electrical device is a lumped filter.

14. The system of claim 1, wherein the electrical device is a discrete device filter.

15. The system of claim 1, wherein the electrical device is a microstrip filter.

16. A system comprising:

N branches including an electrical device in each, wherein N is a positive integer of 1 or greater;

a latching micromagnetic switch system that controls energy flow to each branch, such that only the electrical device in the branch connected to the latching micromagnetic switch system operates, the latching micromagnetic switch system having one or more latching micromagnetic switches, each including, a magnet proximate to a substrate, the magnet producing a first magnetic field;

a cantilever having a magnetic material and a longitudinal axis, the magnetic material making the cantilever sensitive to the first magnetic field, which is approximately perpendicular to the longitudinal axis, the cantilever rotating between a first and second state based on the first magnetic field producing a torque in the magnetic material of the cantilever that maintains the cantilever in one of the first and second states; and a conductor that conducts a current, the current induces a torque in the cantilever based on a second magnetic field, a component of the second magnetic field that is parallel to the longitudinal axis adjusts the direction of the torque produced by the first magnetic field in the magnetic material of the cantilever such that the conductor switches the cantilever between the first and second states, wherein:

the electrical device is a dipole antenna, wherein each pole of the dipole has a predetermined number of conductive traces; and adjacent ones of the conductive traces are coupled together via the latching micromagnetic switch system.

* * * * *